US008397391B2

(12) United States Patent
Ohly et al.

(10) Patent No.: US 8,397,391 B2
(45) Date of Patent: Mar. 19, 2013

(54) DEVICE, SYSTEM AND METHOD FOR THE FITTING AND PRODUCTION OF BRASSIERES

(75) Inventors: Derek Ohly, Somerville, MA (US); Christiana Andersen, Acton, MA (US)

(73) Assignee: Zyrra LLC, Arlington, MA (US)

( * ) Notice: Subject to any disclaimer, the term of this patent is extended or adjusted under 35 U.S.C. 154(b) by 441 days.

(21) Appl. No.: 12/691,717

(22) Filed: Jan. 21, 2010

(65) Prior Publication Data

US 2010/0242291 A1 Sep. 30, 2010

Related U.S. Application Data

(60) Provisional application No. 61/146,049, filed on Jan. 21, 2009, provisional application No. 61/152,030, filed on Feb. 12, 2009.

(51) Int. Cl.
*A41H 3/00* (2006.01)

(52) U.S. Cl. ..... 33/17 R; 33/2 R; 33/512

(58) Field of Classification Search ..... 33/17 R, 33/2 R, 512
See application file for complete search history.

(56) References Cited

U.S. PATENT DOCUMENTS

| | | | | |
|---|---|---|---|---|
| 2,109,823 | A * | 3/1938 | Guillot | 33/2 R |
| 2,559,501 | A * | 7/1951 | Graf | 33/2 R |
| 2,575,343 | A * | 11/1951 | Heiman | 33/2 R |
| 2,946,125 | A * | 7/1960 | Gittelson | 33/2 R |
| 3,979,831 | A * | 9/1976 | Lutz | 33/17 R |
| 4,519,137 | A * | 5/1985 | O'Boyle et al. | 33/17 R |
| 5,414,943 | A * | 5/1995 | Vogt | 33/764 |
| 6,415,199 | B1 * | 7/2002 | Liebermann | 700/132 |
| 6,751,877 | B2 * | 6/2004 | Grove | 33/17 R |
| 7,118,444 | B2 | 10/2006 | Newman | |
| 7,127,827 | B2 | 10/2006 | Vogt Saladucha | |
| 7,162,441 | B2 | 1/2007 | Nabarro | |
| 7,164,962 | B2 | 1/2007 | Petterson | |
| 7,232,359 | B1 * | 6/2007 | Richardson | 450/86 |
| 7,325,317 | B2 | 2/2008 | Matchett et al. | |
| 7,648,408 | B2 * | 1/2010 | Lung | 450/58 |
| 7,824,242 | B2 * | 11/2010 | Perman et al. | 450/41 |
| 2008/0027744 | A1 | 1/2008 | Nethero | |
| 2009/0075562 | A1 | 3/2009 | Lung | |
| 2011/0218876 | A1 * | 9/2011 | Sorrentino | 705/26.7 |

FOREIGN PATENT DOCUMENTS

JP 06049703 A * 2/1994

* cited by examiner

*Primary Examiner* — Christopher Fulton
(74) *Attorney, Agent, or Firm* — Grossman, Tucker, Perreault & Pfleger, PLLC

(57) ABSTRACT

The present disclosure relates to a device, a fitting bra for making measurements for a customized bra. In addition, the method may include first selecting an underwire size, measuring an across cup dimension to provide an across cup measurement, measuring a center distance to provide a center distance measurement, and measuring a back dimension to provide a back measurement. The method may also include selecting a fitting bra based on the selected underwire size. Further a system is contemplated for providing a customized bra.

17 Claims, 24 Drawing Sheets

DEVICE, SYSTEM AND METHOD FOR THE FITTING AND PRODUCTION OF BRASSIERES

CROSS REFERENCES TO RELATED APPLICATIONS

This application claims the benefit of the filing dates of U.S. Provisional Application No. 61/146,049, filed on Jan. 21, 2009 and U.S. Provisional Application No. 61/152,030 filed on Feb. 12, 2009, the teachings of which are incorporated herein by reference.

FIELD OF THE INVENTION

The present invention relates to an adjustable fitting bra for taking measurements to develop a customized bra and a system and method for obtaining measurements and utilizing the measurements for producing a customized bra.

BACKGROUND

Many women utilize bras for the support, covering and/or shaping of a woman's breasts. Typically, bras are fitted utilizing two measurements, the bust circumference and the torso circumference. While such measurement techniques may produce a "close fit," they do not necessarily produce a "correct fit." Furthermore, if a woman is wearing an ill fitting bra or no bra while the measurements are taken, it is likely that the next bra will be ill fitting unless close attention is paid to the fit of the next bra with regard to factors such as the placement of the band across the back or the fall or placement of the underwire along the sternum. However, as it may be appreciated, every woman's body is relatively different, including their breast size, shape and positioning, which may dictate how close the "close fit" may get.

In some circumstances, women may choose to purchase an "off the shelf bra" and have the "off the shelf" bra altered by a tailor or a seamstress. However, fabric alterations may lead to issues with fabric integrity. In addition, the alterations made to one part of the bra, such as shortening a back, may cause other portions of the bra to deform, which may affect the fit of the cups and/or the underwire. Furthermore, one may have a custom bra made. However, customization may take some time as a new pattern may need to be developed for each individual.

SUMMARY OF THE INVENTION

An aspect of the present disclosure relates to a fitting bra for making measurements. The fitting bra may include two underwires and two cups, each cup supported by one of said underwires. In addition, the fitting bra may include a bridge adjustment strap, configured to adjust a bridge width, wherein the bridge adjustment strap may include a second fastening element configured to mechanically couple to a first fastening element. The fitting bra may also include a band affixed to the cups including a first free end and a second free end, wherein the second free end includes a third fastening element and a back attached to the first free end of the band and mate-able to the second free end. The back may have a length and include a plurality of fourth fastening elements provided along at least a portion of the length, wherein the third fastening element is configured to mechanically couple to at least one of the fourth fastening elements. Further, the fitting bra may include at least one strap, wherein the strap includes a first end and a second end, wherein the first end is affixed to one of the cups and the second end is affixed to the band.

Another aspect of the present disclosure relates to a method of providing a customized bra. The method may include first selecting an underwire size, measuring an across cup dimension to provide an across cup measurement, measuring a center distance to provide a center distance measurement, and measuring a back dimension to provide a back measurement. The method may also include selecting a fitting bra based on the selected underwire size. In another example, the method may include comparing the underwire size, the across cup measurement, the center distance and the back measurement to a standard model of a base pattern to provide a customize pattern.

A further aspect of the present disclosure relates to a system for providing a customized bra, the system comprising one or more storage mediums having stored thereon, individually or in combination, instructions. When the instructions are executed by one or more processors the following may result in: comparing inputs to a standard model, wherein the inputs include an underwire size, an across cup measurement, a center distance measurement and a back measurement, and the standard model includes a base underwire size, a base across cup measurement, a base center distance measurement and a base back measurement for a base pattern; calculating difference numbers between the inputs and the standard model; and adjusting the base pattern according to the difference numbers to provide a customizable pattern.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1A:
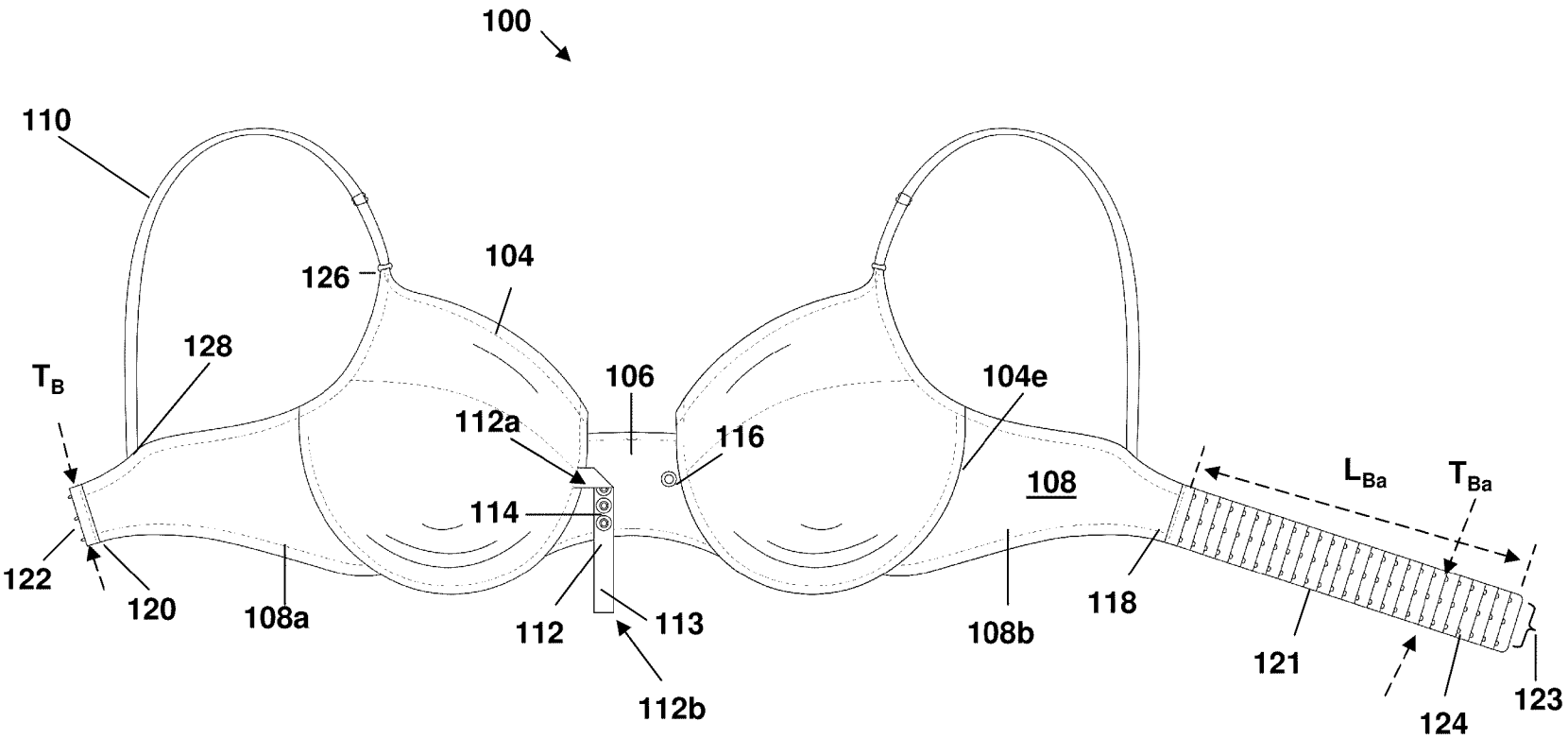
FIG. 1*a* illustrates the front of an example of a fitting bra.

It is to be understood that this disclosure is not limited in its application to the details of construction and the arrangement of components set forth in the following description or illustrated in the drawings. The embodiments herein are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Further, reference to the term "horizontal" implies being generally parallel to the surface of the ground, wherein the term "vertical" implies being generally perpendicular to the surface of the ground.

The present invention relates to an adjustable fitting bra for taking measurements to develop a customized bra and a system and method for obtaining measurements and utilizing the measurements for producing a customized bra. Measurements may be taken using the fitting bra, which may then be compared against one or more standards to produce a custom fitting bra, with the aim of achieving a "correct fit." From the differences between the standards and the actual measurements, customized patterns may be developed to create the customized bra.

Figure 1B:
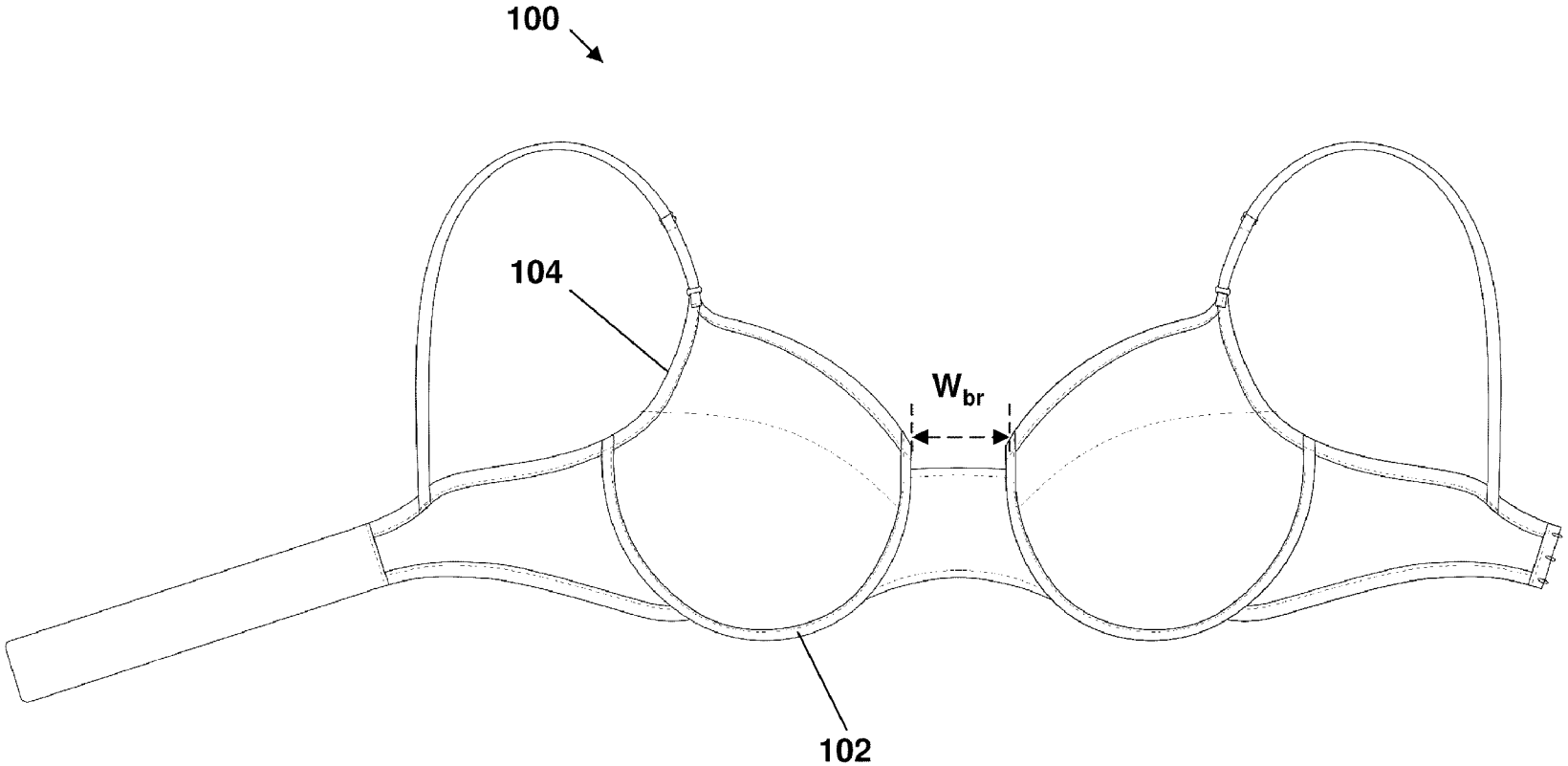
FIG. 1*b* illustrates the back of an example of a fitting bra.

As illustrated in FIGS. 1*a* and 1*b*, the fitting bra 100 may generally include two underwires 102, two cups 104, a bridge extending between the cups 106, a band that runs around the torso providing support for the cups 108, and shoulder straps 110. The underwire 102 or reinforcing portion, which may be sized based upon the size of the breast, may support the cups 104. The underwire 102 may generally extend underneath the breast from the point the breast meets the sternum at the infra-mammary fold, along the infra-mammary fold and to a point where the breast tissue meets the rib cage near the under arm. In addition, the underwire 102 may optionally extend up along the exterior portion of the breast proximate to or under the arm and optionally up the interior portion of the breast proximate the sternum to provide additional support. It may be appreciated that the underwire 102, need not necessarily be a wire, but may be a wire in some examples. In other examples, the underwire may be formed of polymeric material and/or fabric. The underwire 102 may vary in terms of its rigidity, dimensions (width, thickness or length) and shape. The underwire 102 forms the measurement foundation and a number of fitting bras having different underwire sizes may be provided.

Each fitting bra 100 underwire 102 may correspond to a combination of band and cup sizes. Table 1 illustrates a comparison of band/cup sizes to exemplary wire sizes.

TABLE 1

Example fitting bra equivalency chart.

| | Bra Size | | | | | | | | | |
|---|---|---|---|---|---|---|---|---|---|---|
| | 32A/B | 34A/B | 36A/B | 38B | 40B | 42B | 44B | 46B | 48B | 50B |
| | | | 34C | 36C<br>34D<br>32DD | 38C<br>36D<br>34DD<br>32DDD | 40C<br>38D<br>36DD<br>34DDD | 42C<br>40D<br>38DD<br>36DDD | 44C<br>42D<br>40DD<br>38DDD | 46C<br>44D<br>42DD<br>40DDD | 48C<br>46D<br>44DD<br>42DDD |
| Wire Size | 1 | 2 | 3 | 4 | 5 | 6 | 7 | 8 | 9 | 10 |

It may be appreciated that the various notations may be used for the different wire sizes. In the above example, the different underwire sizes are indicated by the numbers 1 through 10. However the sizes may be labeled, for example, alphanumerically using the Roman or Greek alphabet or by other notations.

As noted above, determination of cup size has generally been based upon the difference between the bust circumference $B_c$ and the torso circumference $T_c$, as illustrated in FIG. 2. More specifically, the torso circumference is measured in inches (in this example) just under the bust. Then the torso measurement is adjusted. That is, if the torso measurement is odd, five inches are added to the measurement, and if the measurement is even, four inches are added to the measurement. Then the bust circumference is measured at its fullest part. The adjusted torso measurement is then subtracted from the bust measurement and the difference is used to determine the cup size according to Table 2, which includes cup sizes from AA to G.

TABLE 2

Approximate cup sizes based on bust and torso circumference.

| Difference (inches) | Cup Size |
|---|---|
| <1 | AA |
| 1-2 | A |
| 2-3 | B |
| 3-4 | C |
| 4-5 | D |
| 5-6 | E or DD |
| 6-7 | F or DDD or EE |
| 7-8 | G or FF or EEE |

However, the above (i.e., bust/torso measurements) does not necessarily provide an accurate indication of which cup size may be appropriate for a given breast, as the breast tissue may fall differently on each individual. For example, some individuals may need a larger wire with a shallow cup, whereas some individuals may need a smaller wire with a deeper cup. Accordingly, as contemplated by the methods provide for herein, an underwire 102 may first be selected based on fitting the underwire 102, itself, to the breast may result in a more appropriate underwire 102 size, prior to fitting the cups and/or band. The fitting bra 100 may then be selected from a series of fitting bras 100 based on the selected underwire and the cups and/or band may then be determined.

As noted above, the underwire 102 may support the cups 104. In some examples, the underwire 102 may be integrated into the base of the cups 104 or the underwire 102 may be positioned into a sleeve to which the cups 104 are attached. The cups 104 of the fitting bra 100 may be rather large to accommodate most depths for each underwire size. This may result in cups that are too large for most people who may be fitted. For example, an across cup size of up to 18 inches may be provided, depending on the size of the underwire selected. Thus, across cup sizes for the fitting bra may be in the range of 6 inches to 20 inches, including all values and increments therein. Table 3 lists examples of across cup measurements for the various wire sizes for the fitting bras.

TABLE 3

Examples of across cup measurement for various underwire sizes for the fitting bra.

| Size | Across Cup Measurement (inches) |
|---|---|
| 1 | 8.5 |
| 2 | 9.25 |
| 3 | 10.5 |
| 4 | 11.5 |
| 5 | 12.25 |
| 6 | 13 |
| 7 | 14 |
| 8 | 15 |
| 9 | 16 |
| 10 | 18 |

The across cup sizes for the underwires sizes may be based on a given population and may vary depending on the population or may be affected by factors such as the difficulty to support a given across cup size by a given underwire.

Once a properly fitting underwire is in place, an across cup measurement, apart from the across cup size of the fitting bra, may be gathered. The size of the cup 104, referring back to FIGS. 1*a* and 1*b*, may be adjusted during fitting by gathering the cup by pulling up on the shoulder straps 110 and/or pinning the cup around the breast. The cups 104 may be adjusted until the desired support or shape is achieved. Once the desired support and shape is achieved an across cup measurement may be provided. It may be appreciated that the across cup measurement may in some cases be as large as the actual cup size of the fitting bra. However, the across cup measurement in many examples may be smaller than the across cup size of the fitting bra. Furthermore, if the across cup measurement is larger than the across cup size of the fitting bra a decision may be made, in some examples, to utilize the next size underwire.

As illustrated in FIG. 2, the across cup measurement $A_c$ may be understood as the distance across the largest portion of each breast from where the breast tissue meets the sternum 210 to where the breast tissue meets the ribcage 212 proximate to or under the arm. More specifically, the across cup measurement may be understood as is a horizontal measurement across the largest potion of the breast (e.g., with the fitting bra on) from the inside edge of the wire near the sternum to the inside edge of the wire near or under the arm, therefore the measurement may not accommodate the wire itself. If the across cup measurement of one breast is larger than the other a decision may be made as to which measurement may be used and in some examples, both measurements may be used, that is separate cup patterns may be developed for each breast.

The fitting bra cups 104 may be provided with a fabric that exhibits a known degree of stretching such as up to 1 inch per 12 inches of fabric independently in the machine and cross-machine directions of the fabric, including all values and increments in the range of 0.1 inches per 12 inches of fabric to 1 inch per 12 inches of fabric independently in the machine and/or cross-machine directions of the fabric. Further, the fabric may exhibit little to no stretch or give. The fabric forming the cups 104 may be woven or nonwoven fabric. In addition, one or more layers of fabric may be included. Optionally, a lining may be provided as well, wherein the lining may include a woven or nonwoven fabric.

As the bridge 106 may dictate the distance between the two cups 104, the bridge may include an adjustment strap 112, wherein a proximal end of the strap 112*a* may be affixed to one side of the bridge 106, for adjusting the two cups 104 relative to each other, (i.e., positioning the cups closer together or farther apart). The bridge 106 may be wider than typically provided (up to 2 inches in width, depending on the underwire size) to allow for adjustment of the bridge width $W_{Br}$ between the cups and accommodate those situations where the bridge needs to be wider than typical. To fix the bridge width, the adjustment strap may include a first fastening element 114 that mates, or mechanically couples to a second fastening element 116 on the bridge 106. For example, a hook or eyelet may be provided on the bridge 106, which may latch onto one or more mating hooks or eyelets provided on the bridge. Other fasteners may include snaps, buttons, or hook and loop fasteners. The fasteners may be coupled and/or decoupled to adjust the width. One or more second fastening element may be provided across the width of the bridge or along the bridge adjustment strap 112 (as illustrated) including in the range of 1 to 6 second fastening elements, including all values and increments therein. In some examples, the second fastening elements may be spaced at fixed distances or intervals across the width. A tail 113 may be provided on the distal end 112*b* of the bridge adjustment strap for assisting in adjusting the bridge width. In addition, the bridge adjustment strap 112 may exhibit little stretch, such the fabric may exhibit 0.25 inches or less of stretch for every 12 inches of fabric exhibited independently in either the machine and/or cross-machine directions of the fabric, including all values and increments in the range of 0.01 inches to 0.25 inches of stretch for every 12 inches of fabric exhibited independently in either the machine and/or cross-machine directions of the fabric. In some examples, the bridge adjustment strap is formed from a material that exhibits little to no stretch, such as a non-woven fabric. In some examples, the bridge 106 and the adjustment strap 112 are integrated and form one piece, where the bridge passes through a loop or ring and folds over itself. Again, the bridge may include a first fastening element 114 and the adjustment strap 112 may include at least one second fastening element 116.

The bridge 106, at the smallest distance between the cups $W_{Br}$, may be adjustable from 0.25 inches to 2.0 inches, including all values and increments therein, such as 1.5 inches to 2.0 inches. In some examples, the smallest distance between the cups may be at the top of the bridge. In other examples, the smallest distance may be somewhere between the top and the bottom of the bridge and in further example, the smallest distance may be at the bottom of the bridge. Further adjustment may be made at intervals between 0.0625 inch increments to 0.25 inch increments, depending on the adjustment mechanism. For example, where the adjustment may be provided using hook and loop fastener, the adjustment may be relatively fine at 0.0625 inch increments, whereas if snaps or eye hooks are utilized, the adjustment may be in 0.375 inch increments. It may be appreciated, that in some cases, the bridge 106 may be left at its longest length. By adjusting the distance between the cups 104, a center distance measurement may be provided equal to the bridge width $W_{Br}$.

As noted above, a band 108 may be provided that runs around the torso and connects and/or supports the cups 104. In some examples, the band 108 may run under the bust and may include two free ends 118, 120. The cups 104 may be attached to the band 108 at, for example, the cup exterior side 104*e* and along a portion of the underwire. In other examples, the band 108 may include two sections or pieces 108*a*, 108*b*, each piece 108*a*, 108*b*, having a first end affixed to an exterior cup side 104*e* and a free end 118, 120. Each side of the band 108 may extend from the cup to the free ends 118, 120 a distance of 5 inches or less, including all values and increments therein, such as from 2 inches to 5 inches.

Figure 1C:
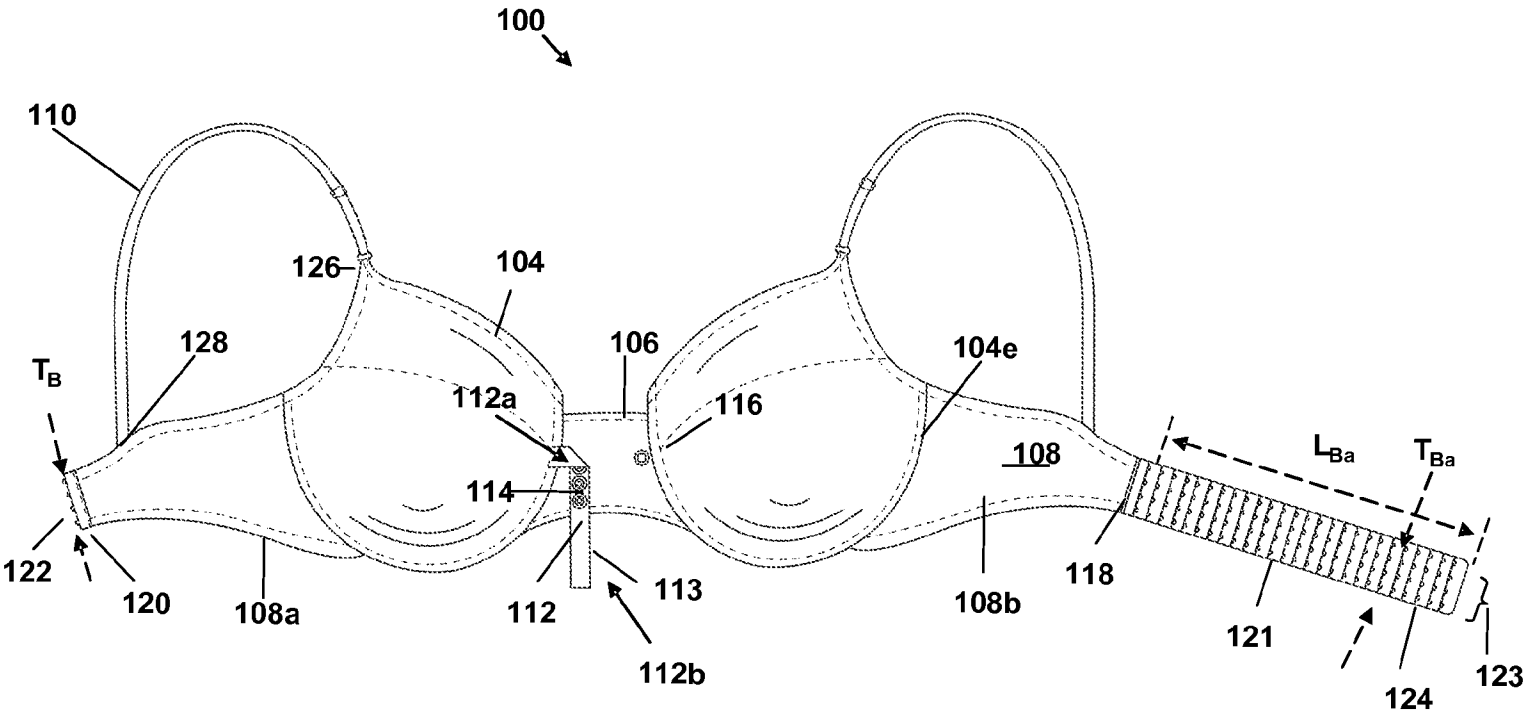
FIG. 1*c* illustrates the front of an example of a fitting bra.

In addition, the fitting bra may include a back 121 affixed to one (a first) free end 118 and mate-able to the other (or second) free end 120. The back 121 may be in the range of 6 inches to 20 inches, including all values and increments therein, such as 12 inches, 13 inches, etc. The back 121 and free end 120 of the band 108, as illustrated in FIG. 1*c*, may be mate-able by third and fourth fastening elements 122, 124, which are configured to mechanically couple, join or mate together and/or decouple to adjust the effective back length. In addition, one or more third and fourth fastening elements 122, 124 may be provided. The third and fourth fastening elements 122, 124 may include hook and eyelet fasteners, hook and loop fasteners, snaps, etc.

In some examples, the fasteners 122, 124 may be provided in a series 123 across the thickness $T_{Ba}$ of the back 121 and/or band 108 and may be distanced apart at set increments, wherein at least one third fastening element 122 is provided on one band free end 120 and at least one fourth fastening element 124 is provided on a the back 121. More than one fastening element may be provided in a series. Accordingly, it may be appreciated that in the range of 1 to 5 third and fourth fastening elements In other examples, one or more fourth fastening elements 124 may be provided along a portion of or the entire length $L_{Ba}$ of the back 121. For example, fourth fastening elements 124 may be provided along one third, one half, three quarters or along the entire length of the back 121. The fastener elements 124 provided along the length of the back 121 may be provided at set increments, such as 0.25 inch increments or greater, including 0.25 inch increments, 0.5 inch increments, up to 2 inch increments.

While, generally, three series of mating fastening elements, each series including two or three fasteners spread across the thickness of the back or band, are provided along the length of the band, the present fitting bra contemplated providing greater than 5 and up to 21 or even more, such as up to 30 series of fasteners along the length $L_{Ba}$ of the back 121. The tension provided by the band 108 and back 121 may cause the underwire 102 to sit in position around the breasts, such that the wire sits flat, but not distorted by the tension provided from the band 108 and back 121. Adjusting the total length of the back 121, as between the cups 104, may therefore provide a back measurement. It may also be appreciated that extenders including additional fastening elements mate-able with the elements 122 provided on the free end 120 of the band 108 and mate-able with the fastening elements 124 provided on the back 121 may be provided to extend the length of the back when desired or necessary.

In addition, the fitting bra 100 may include shoulder straps 110, each strap attached at a first end 126 to a cup 104 and at a second end 128 to the band 108. The straps 110, in some embodiments, may be adjustable. Adjustment of the straps 110 may be provided using, for example, snaps, hook and eye fasteners or hook and loop fasteners. In addition, in some examples, the straps 110 may be formed of two pieces, wherein a first piece has a first end fixed to the band and a second end having a ring or slide affixed thereon. The second piece may have a first end fixed to the cup and a second end fixed to a slide. The second piece may be threaded through the loop or slide affixed to the first piece and may fold over itself, the length of the second piece being adjustable based on the length of the second piece which is folded over itself.

When adjustments are completed tension on the underwire may be provided by the adjusted bridge and adjusted band, which may mimic the tension provided by a finished bra. As may be appreciated, the fitting bra may provide a relatively comprehensive measuring framework as the pieces, i.e., the bridge, back, cup and shoulder strap may be adjusted individual so that each element of the bra may be assessed. In addition, up to 10 fitting bras, including 10 underwire sizes may be provided in a set. However, it may be appreciated that more than 10 fitting bras or less than 10 fitting bras may be utilized in a set as well. The range may allow the vast majority of women, regardless of body type, to be able to select and put on an appropriate fitting bra for relatively accurate measurement.

It may be understood that in some embodiments, a single underwire and two cups or a single underwire and a single cup may be provided. In such a situation, the back length between the cup and the back free end may be longer. In some circumstances, a single strap may be provided, such as when a single cup may be provided. In further circumstances, a cup may be provided which may hold an insert affix-able thereto. Or an insert may be placed into or integrated into a cup.

Figure 3:
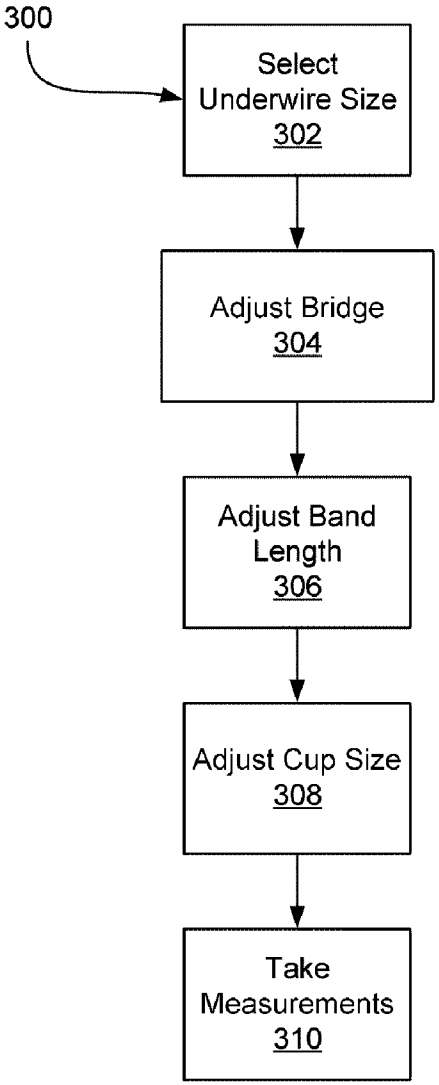
FIG. 3 illustrates an example of a method of taking measurements.

Accordingly, as may be appreciated, a method of fitting a bra is contemplated herein. An example of a method is illustrated in FIG. 3, wherein the method 300 may include or begin with selecting an appropriate underwire size by fitting an underwire to the breast, such that the underwire lies underneath the infra mammary fold 302. The bridge may then be adjusted, based on the distance between the breasts and the desired distance between the cups 304. The band may then be adjusted in length to provide sufficient tension on the underwires such that the underwires may lie flat 306. The cups size may be adjusted to provide proper support and shape and the shoulder straps may adjusted 308. Once the adjustments are made, measurements may be taken 310. The measurements may include wire size, across the cup measurements (of both the left and right breasts), back distance and center distance. It may be therefore be understood that once the underwire has been selected, any of the other adjustments may occur in any given order, depending on the situation, the wearer's preference or the fitter's preference. Furthermore, measurements may be taken once all of the adjustments have been made or while the adjustments are occurring.

It may also be appreciated that further, optional, measurements may be taken, including, for example, the bust circumference and the torso circumference. In addition, certain accommodations may be made for the resulting customizable bra. For example, the wearer may desire a specified number of fasteners to fasten the band of the customizable bra or a given strap thickness may be desired.

The measurements may then be used to make a comparison against standard models to develop a customized pattern for the individual. One or more standard models may be provided. In addition, one standard model may be utilized for one or more underwire sizes. For example, a standard model may be chosen based on breast proportion as determined by a combination of wire size and the across cup measurement. The customized pattern may be a "paper" pattern, a computer aided design (CAD) model, or a list of points which may be used to cut pieces of fabric (fashion fabric or lining) or other materials (i.e., foam, tape or ribbon) sewn or otherwise affixed together to form the customized bra.

Accordingly, in a general sense, a process is contemplated herein for providing a pattern for a customizable bra, wherein the process may generally include collecting or gathering measurements, comparing the measurements to a standard model to obtain measurement differences for adjusting the standard model and creating a pattern based on the measurements. In addition, it is contemplated herein that the process may be executed by hand or by a system, which may include an input file, a computer including one or more memory articles, a processor, code, which may in some cases be embodied by code modules, firmware, and or hardware that provides an output in the form of a pattern.

Figure 4:
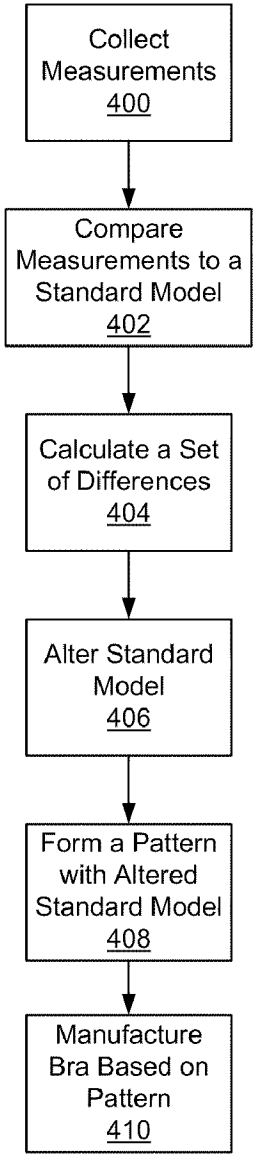
FIG. 4 illustrates an example of method of providing a pattern from a set of measurements.

For example, as illustrated in FIG. 4, once a person has been fitted and the measurements collected 400, the measurements (including the underwire size, the across cup distance, the center distance and the back measurement) may be compared to those provided by a standard model 402. A set of differences between the standard model and the collected measurements may be determined 404. The standard model may then be altered based on the collected measurements 406 to form a pattern 408, which may then in turn be used to manufacture the customizable bra 410.

Figure 5:
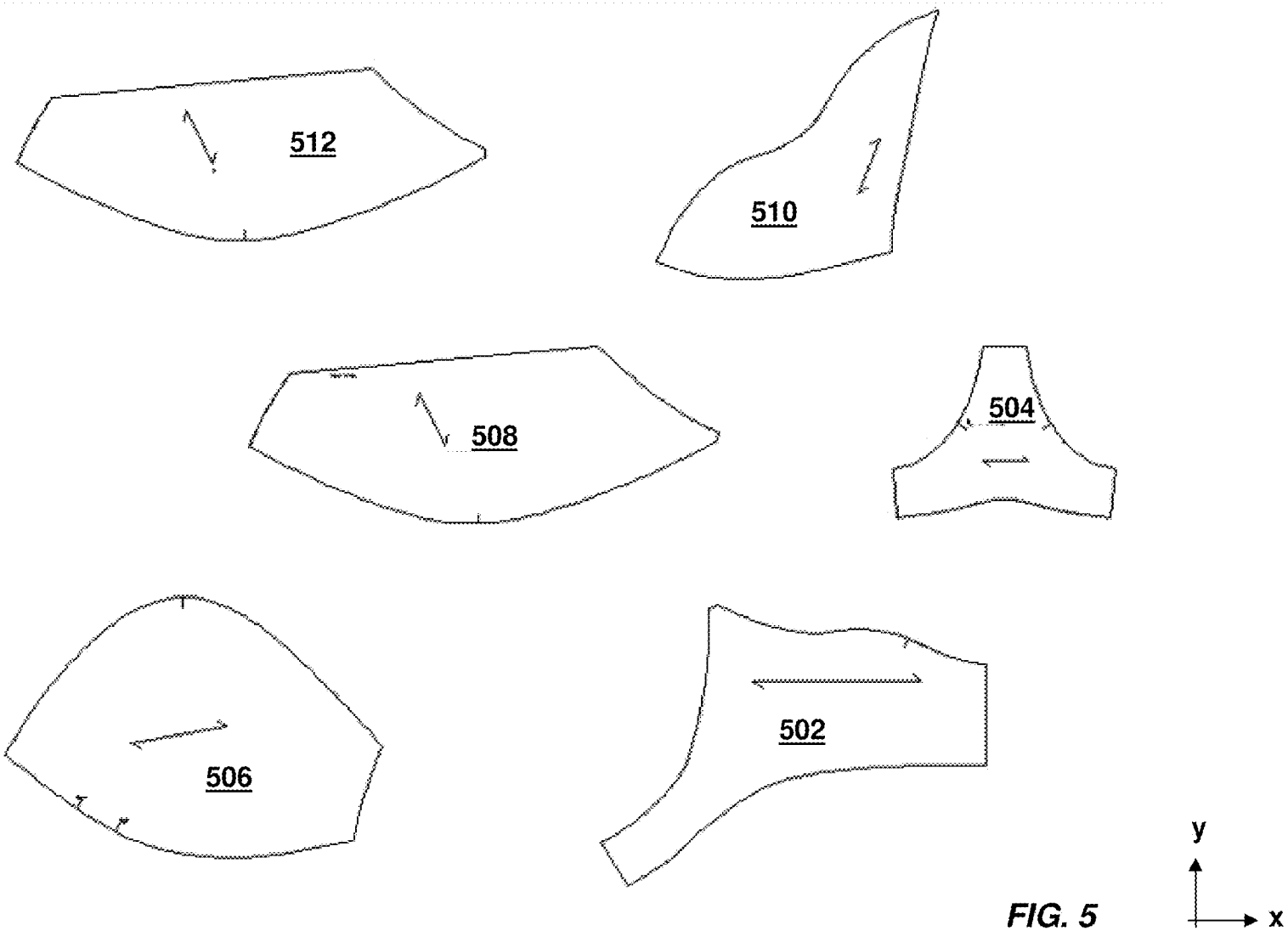
FIG. 5 illustrates an example of a base pattern representing a standard model.

A base pattern may include 4 to 6 pieces that may be assembled together to form a completed bra. As illustrated in the in FIG. 5, the pattern pieces may include, for example, a back 502, a bridge 504, a lower cup 506, an upper cup 508 and optionally a sling 510. In addition, depending on the bra style additional pieces may be provided, for example, an upper cup "fashion" pattern piece 512 may be included to provide for a lace cover layer over the upper cup. Similar "fashion" pattern pieces may be provided for the individual portions of the bra, e.g., the back, bridge, and lower cup. It may be appreciated that the patterns, both the base patterns and the customized patterns may include seam allowances, darts, indications on the number of fastener elements accommodated for, where to place fastener elements and where to line the pattern pieces up to sew the pieces together.

Figure 6:
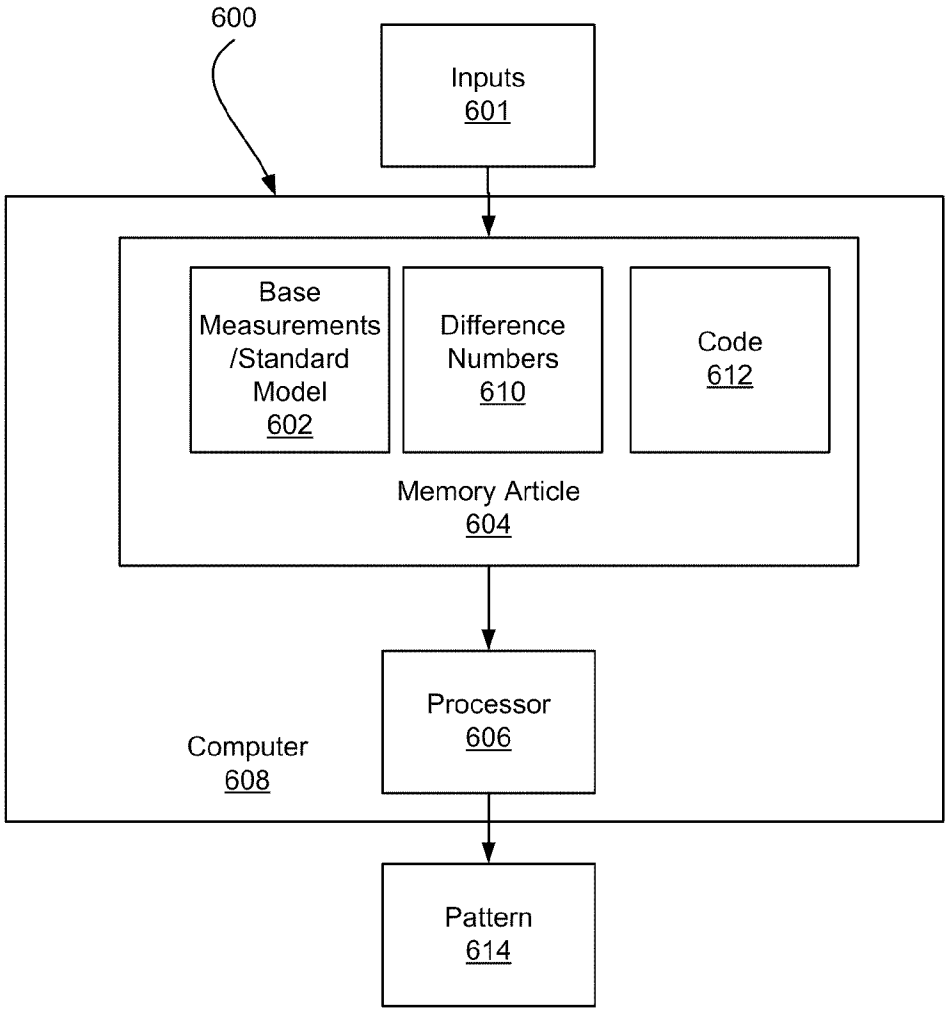
FIG. 6 illustrates an example of a system for creating a customized pattern.

Each standard model may be based on a base pattern, which may be understood to be a pre-defined pattern that contains or illustrates the design cut for a bra related to the specific set of base measurements forming the standard model. A number of standard models, and therefore base patterns, may be used. For example, in the context of a system, an example of which (system 600) is illustrated in FIG. 6, the standard models and/or base patterns forming the standard models 602 may be in the form of data stored in a memory article 604, in a computer 608. It may be appreciated that the memory article may include fixed memory, read-only memory, random access memory or other data storage forms, including compact discs, dvds, etc. The memory article may also include removable articles, such as compact discs, dvds, removable hard drives, Flash Memory including NAND Flash Memory, etc. The data may be stored as a set of coordinates, or points, curves, etc. in a database or a look-up table. In other examples, the base patterns may be paper patterns and the standard models may be calculated from the base paper patterns.

The collected measurements may be compared to corresponding base measurements of the standard model. That is, the selected underwire size and collected across cup, center distance and back measurements are compared to a base underwire size and base across cup measurement, a base center distance measurement and a base back measurements of the standard model, which the base pattern is based on. Based on the differences between the base measurements of the standard model and the collected measurements, specific sets of points forming the pattern may be individually manipulated. The differences between the base measurements of the standard model and the collected measurements are referred to herein as "difference numbers". For example, if the base back measurement is 17 inches and the collected back measurement is 19 inches, then the "back difference measurement" is a positive 2 inches, whereas if the collected back measurement is 16 inches, the "back difference measurement" is a negative 1 inch. Additional difference numbers may include underwire difference numbers, across cup difference numbers and center distance difference numbers.

In some examples, the collected measurements, may be provided as inputs 601 in a file such as a text file, a CAD file, a measurement file, etc. The difference numbers 610 calculated from the collected measurements may be calculated by hand or by a processor 606 provided inside a computer 608. The difference numbers 610 may be calculated by an code, such as an executable program 612, such as an EXCEL spreadsheet or by code executing a macro, and stored in memory article 604.

The base pattern may then be plotted or already plotted in a base pattern file 602 stored in the memory article 604. For example, the base pattern may be defined as a series of points. Each point of the pattern may be defined in an (x,y) coordinate plane. Straight lines may be defined by two points ($x_a$,$y_a$; $x_b$$y_b$), whereas curved lines may be defined by 3 or more points ($x_a$,$y_a$; $x_b$$y_b$; $x_c$,$y_c$), including two end points ($x_a$,$y_a$; $x_b$$y_b$) and a focal point ($x_c$,$y_c$), which may be understood as the intersection of two straight lines drawn at a tangent to each of the end points. It may be appreciated that the further the focal point ($x_c$,$y_c$) is from the direct line between the end points ($x_a$,$y_a$; $x_b$$y_b$), the sharper the curve is. In one example the base pattern file may be plotted by or may exist as a plotted file in code 612 such as pattern making software, including, for example, PATTERNMAKER, provided by Patternmaker Software of WA, as well as other code that may provide computer aided drawing.

The points of the base pattern may then be moved according to the calculated "difference numbers". For example, a macro may be run in the code 612 where the base pattern is plotted to adjust appropriate base pattern points. Accordingly, it may be appreciated that each pattern piece may react to the measurement differences.

Figure 7:
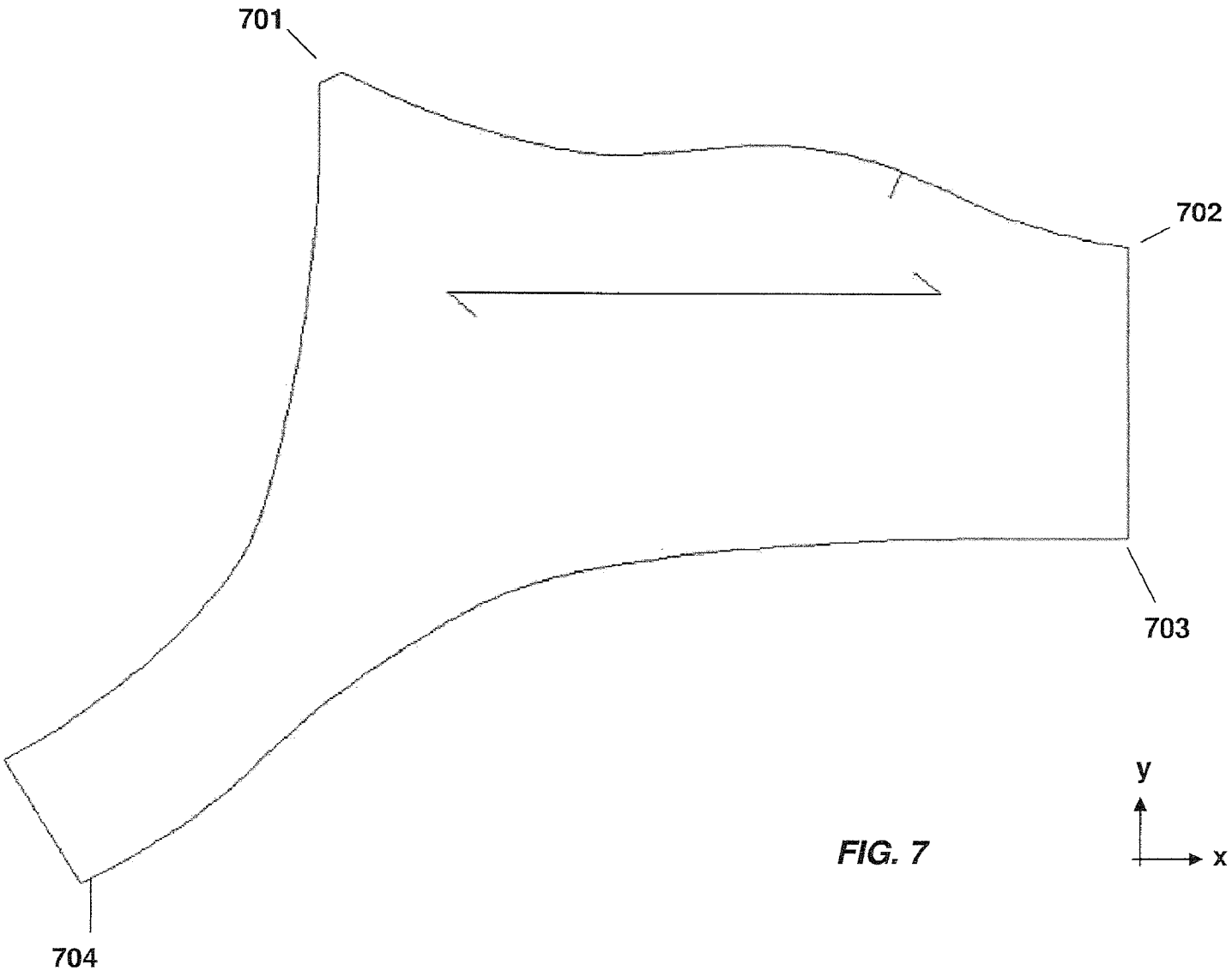
FIG. 7 illustrates an example of a band base pattern.

The following illustrates examples of how the base patterns may be altered based on adjustments of the underwire size, across cup measurements, bridge measurements and back measurements. For example, according to one embodiment, as illustrated in FIG. 7, the band base pattern piece 700 is the piece that, when cut from fabric, connects the cups together. As noted above, the band may include two pieces and the pattern piece for the band may include one pattern piece utilized two times to form each side of the band. The free ends of the two band pieces (represented by points 702 and 703) may be connect-able together via fastening elements and the band pieces may be connected to the cups along the line between points 701 and 704 (or proximate to the line providing for the seam allowance) by attaching or integrating the band pieces to the cups. It may be understood that the band size may be adjusted based on the collected back measurement.

Figure 8:
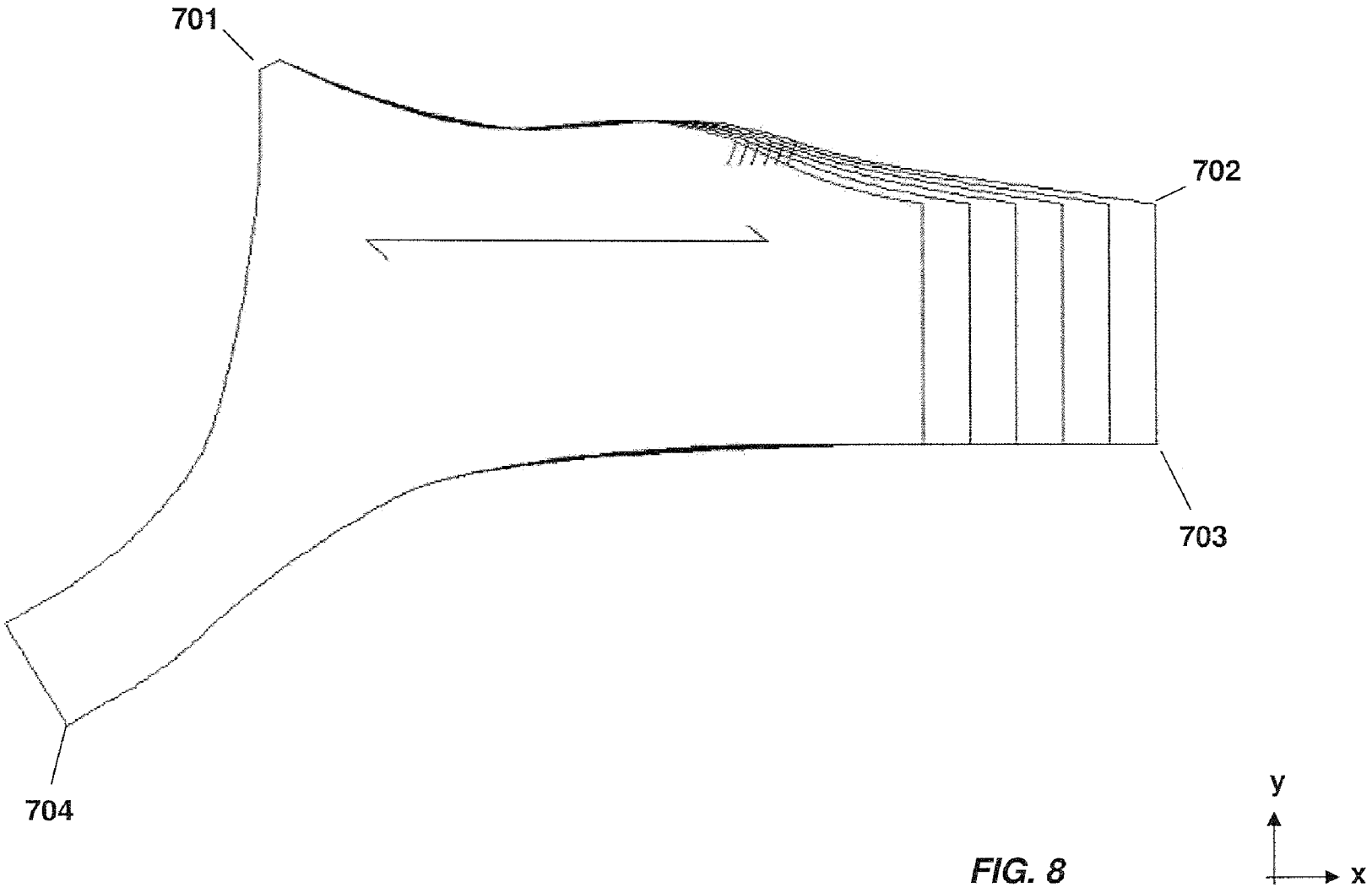
FIG. 8 illustrates an example of a nested pattern showing the effect of an adjustment of the back measurement on the band base pattern, wherein the back measurement is adjusted by 1 inch in each permutation.

A positive back difference may result in the free end of the back (points 702 and 603) to move away to the fixed end of the band piece (points 701 and 704), which may then create a longer band. The length of the band piece may be increased by 50% of the back measurement difference (or less, depending on the stretch of the fabric used to form the customizable bra) as there are two band pieces. For example, if the back difference number is positive two inches, the length of the back piece will be increased by 1 inch (or less) from the base back measurement of the base pattern. FIG. 8 illustrates a nested pattern 800, which illustrates how the band base pattern may be changed by adjusting the band length. Each permutation illustrates a one inch change in the back measurement, without adjusting other measurements such as the across cup measurement. It is noted that the reference points of the base pattern of FIG. 7 are maintained for purposes of clarity. In one example, for an increase in back measurement of 1 inch, Table 4 illustrates the adjustment or change (Δ) that may be made to the points in relationship to the x and y axis.

TABLE 4

Adjustments in points relative to the x and y axis for an increase in back measurement by 1 inch.

| Point Number | ΔX (inches) | ΔY (inches) |
|---|---|---|
| Point 701 | 0 | 0 |
| Point 702 | 0.5 | 0 |
| Point 703 | 0.5 | 0 |
| Point 704 | 0 | 0 |

Figure 9:
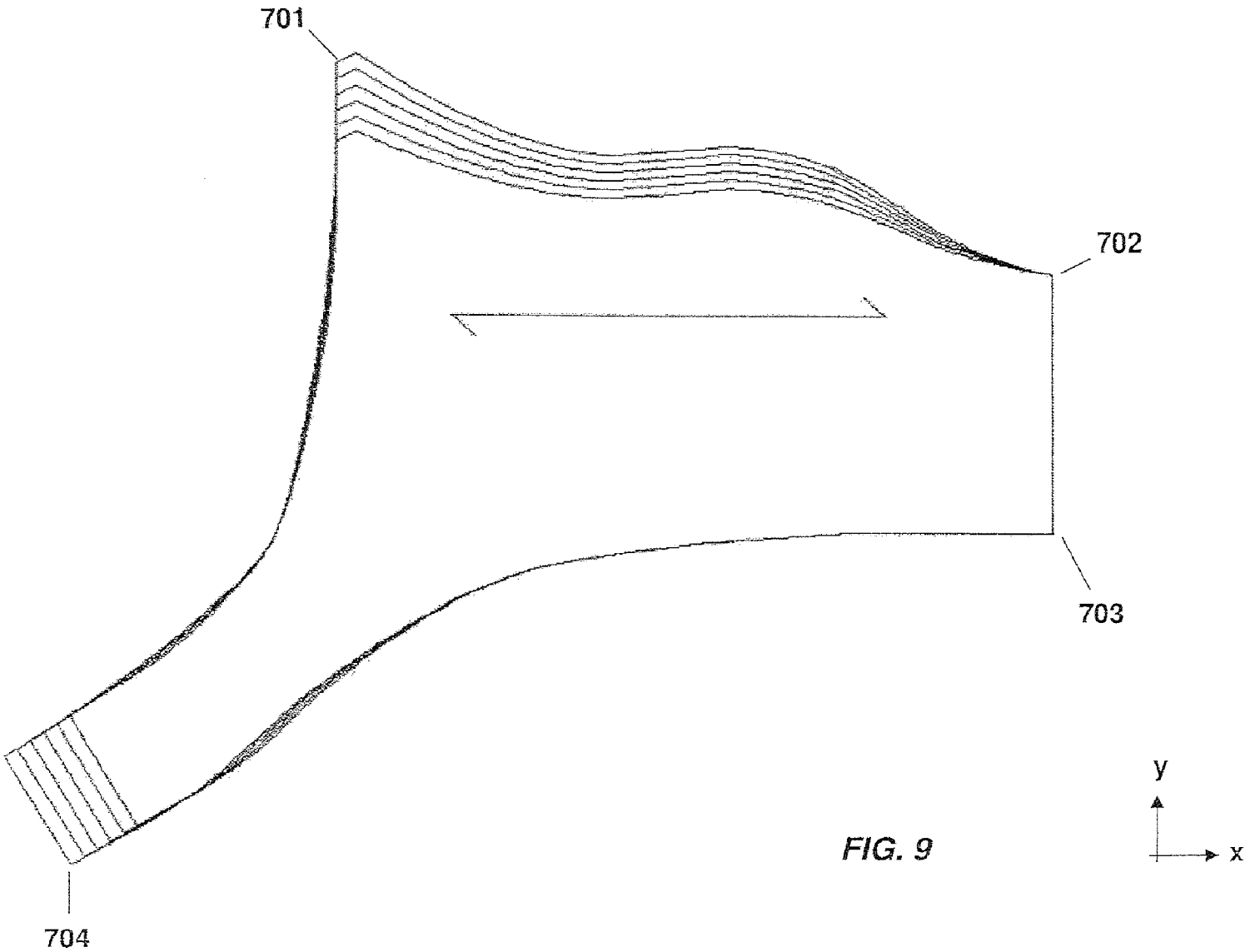
FIG. 9 illustrates an example of a nested pattern showing the effect of adjustments in underwire size on the band base pattern, wherein each permutation is an adjustment of the underwire size by 1.

The height of the band at the points that it connects with the cup illustrated by points 701 and 704 in FIG. 7, may change based on the selected underwire difference number. A positive wire difference number may cause the band to increase in height or thickness by moving points 701 and 704 away from each other. FIG. 9 illustrates a nested pattern 900 demonstrating the effect of adjustment on the band based on changes of the underwire size, wherein each sequential permutation is a 1 size adjustment. Again, the reference points of the base pattern of FIG. 7 are maintained for purposes of clarity. In one example, for an increase in underwire by 1 size, Table 5 illustrates the adjustment or change (Δ) that may be made to the points in relationship to the x and y axis.

TABLE 5

Adjustments in points relative to the x and y axis for an increase in underwire by 1 size.

| Point Number | ΔX (inches) | ΔY (inches) |
|---|---|---|
| Point 701 | 0 | 0.156 |
| Point 702 | 0 | 0 |
| Point 703 | 0 | 0 |
| Point 704 | −0.132 | −0.083 |

In addition, referring again to FIG. 7, the placement of the fastening elements on the free ends (between points 702 and 703) of the band may be determined based on preference or design constraints to provide sufficient support. The placement of the hooks may be based on the number of fastening elements, the size of the fastening elements and/or the thickness of the band at the free ends. Furthermore, the shape and location of the scoop in the back between 701 and 702 may change based on the size of the strap selected.

Figure 10:
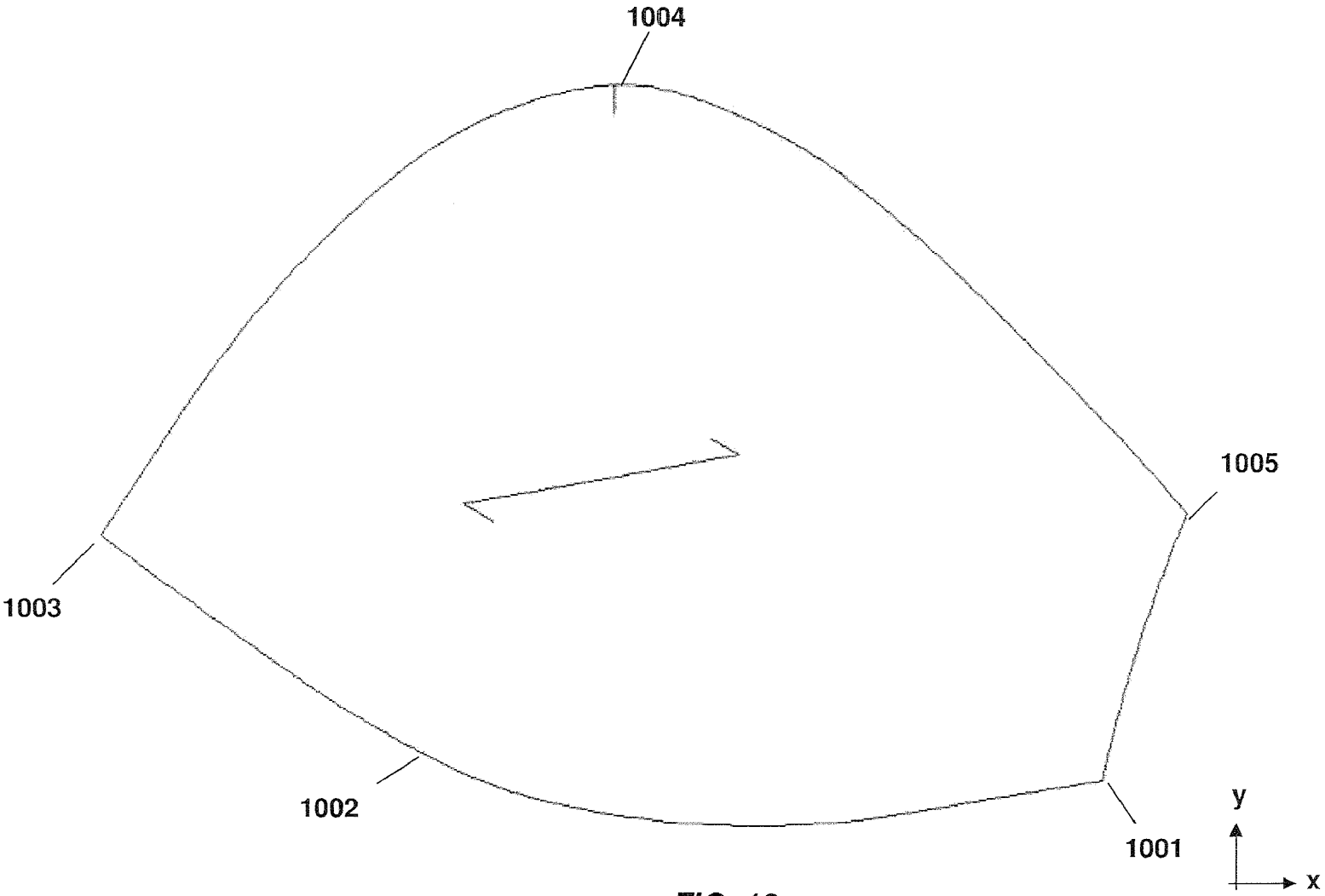
FIG. 10 illustrates an example of a lower or bottom cup base pattern.
Figure 11:
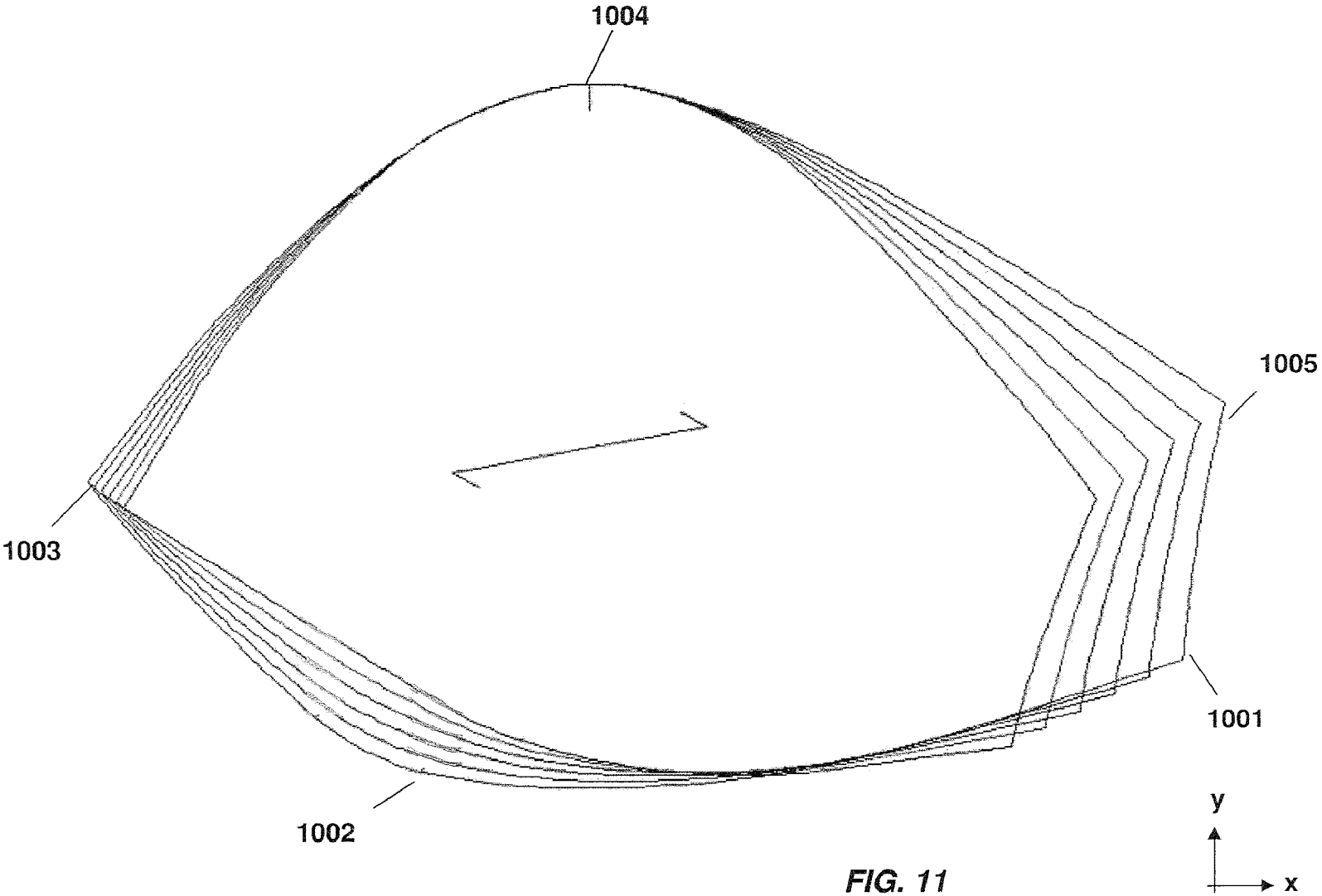
FIG. 11 illustrates an example of a nested pattern showing the effect of adjustments in underwire size on the lower cup base pattern, wherein each permutation is an adjustment of the underwire by 1 size.

FIG. 10 illustrates an example of a lower cup base pattern piece, which provides the lower portion of the bra cup. The geometry of the lower cup may influence the support and shape of the cup. Upon a change in wire size, the length and shape of the bottom curve (between points 1001 and 1003) may be adjusted to accommodate different lengths and shapes of the underwires. A positive wire difference number indicates a wire that may be larger than that of the base pattern. The "wire line" (the lower curve on the lower cup from points 1001 to 1003) may be changed such that the length of the line becomes longer. For example, if the across cup difference number is zero, the shape of the line may change to become a deeper curve, wherein point 1002 move down relative to points 1001 and 1003. FIG. 11 illustrates an example of a nested pattern 1100 where the lower cup base pattern piece is changed based on a change of the underwire size selected, wherein each sequential permutation is an underwire size change of 1. Again, the points are kept consistent with those of the base pattern of FIG. 10. As can be seen in FIG. 11, as the wire size is lengthened, the lower curve is lengthened (along with the entire lower cup portion) and the focal point of the lower curve is adjusted. In one example, for an increase in underwire by 1 size, Table 6 illustrates the adjustment or change (Δ) that may be made to the points in relationship to the x and y axis.

TABLE 6

Adjustments in points relative to the x and y axis for an increase in underwire by 1 size.

| Point Number | ΔX (inches) | ΔY (inches) |
|---|---|---|
| Point 1001 | 0.33 | 0.17 |
| Point 1002 | 0.02 | −0.16 |
| Point 1003 | −0.07 | 0.05 |
| Point 1004 | 0 | 0 |
| Point 1005 | 0.25 | 0.18 |

Figure 12:
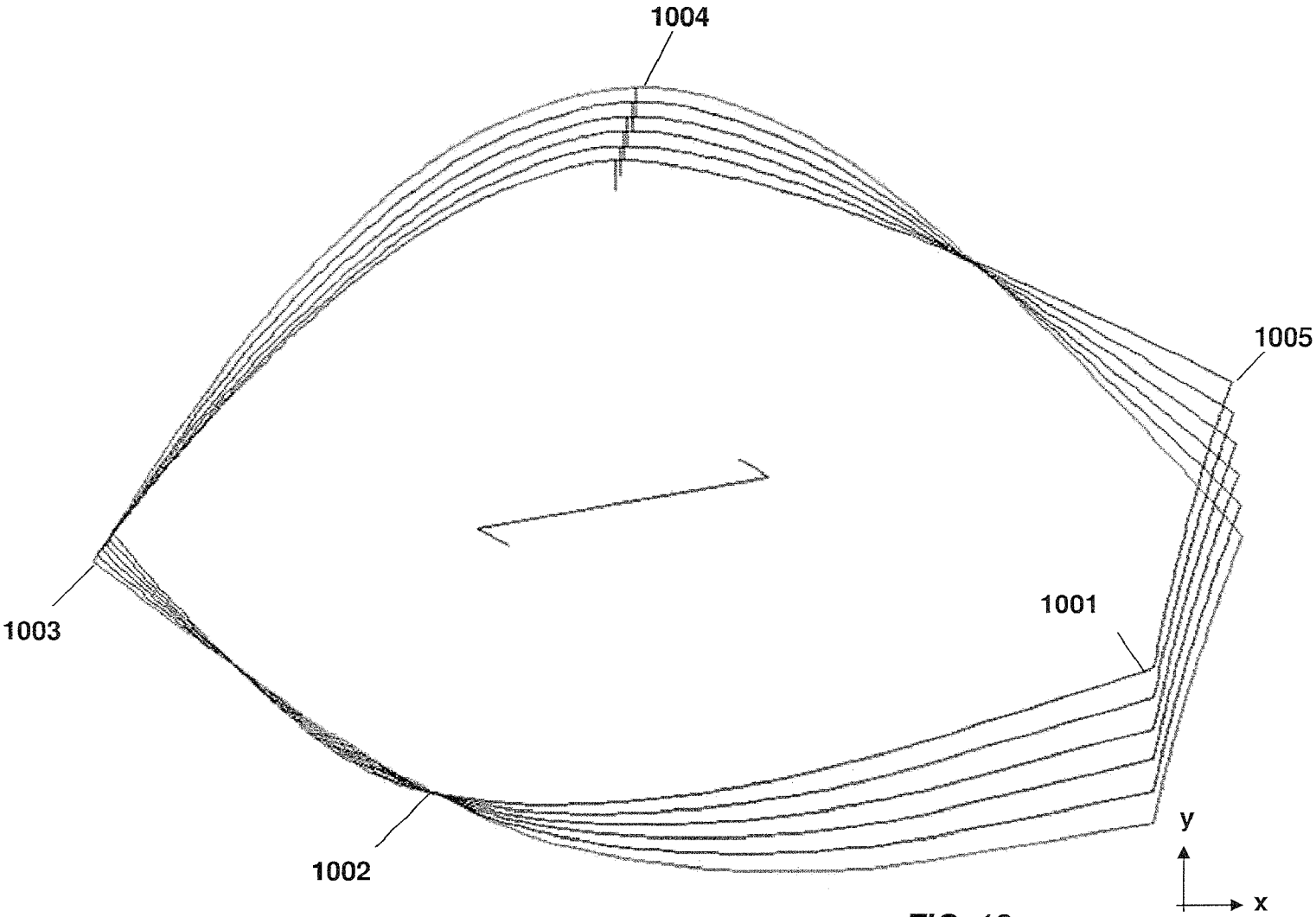
FIG. 12 illustrates an example of a nested pattern showing the effect of adjustments of across cup distance on the lower cup base pattern, wherein each permutation is an adjustment of 0.5 inches.

Referring back to FIG. 10, when the across cup measurement changes, for example, when the across cup difference number is positive, the cup may be deeper and taller than the base pattern. The top line ("the seam line") of the lower cup moves up at point 1004 and becomes longer the top line becomes longer between points 1003 and 1005. The entire line may or may not move down, depending on the model. If the wire difference is zero, then depending on the standard model, the shape of the bottom curve may become shallower to accommodate a deeper cup. The result may be that the center seam of the cup may become longer and the lower cup may become taller. FIG. 12 illustrates an example nested pattern 1200 demonstrating an example of the effect of changes in the across cup measurement on the lower cup base pattern piece, wherein each sequential permutation is a change of 0.5 inches. Again, the points between FIG. 12 and the base pattern of FIG. 10 are maintained for purposes of clarity. In one example, for an increase in the across cup measurement by 0.5 inches, Table 7 illustrates the adjustment or change (Δ) that may be made to the points in relationship to the x and y axis.

TABLE 7

Adjustments in points relative to the x and y axis for an increase in across cup measurement by 0.5 inches.

| Point Number | ΔX (inches) | ΔY (inches) |
|---|---|---|
| Point 1001 | 0 | −0.26 |
| Point 1002 | 0 | 0 |
| Point 1003 | −0.03 | −0.05 |
| Point 1004 | 0.03 | 0.13 |
| Point 1005 | 0.02 | −0.26 |

Figure 2A:
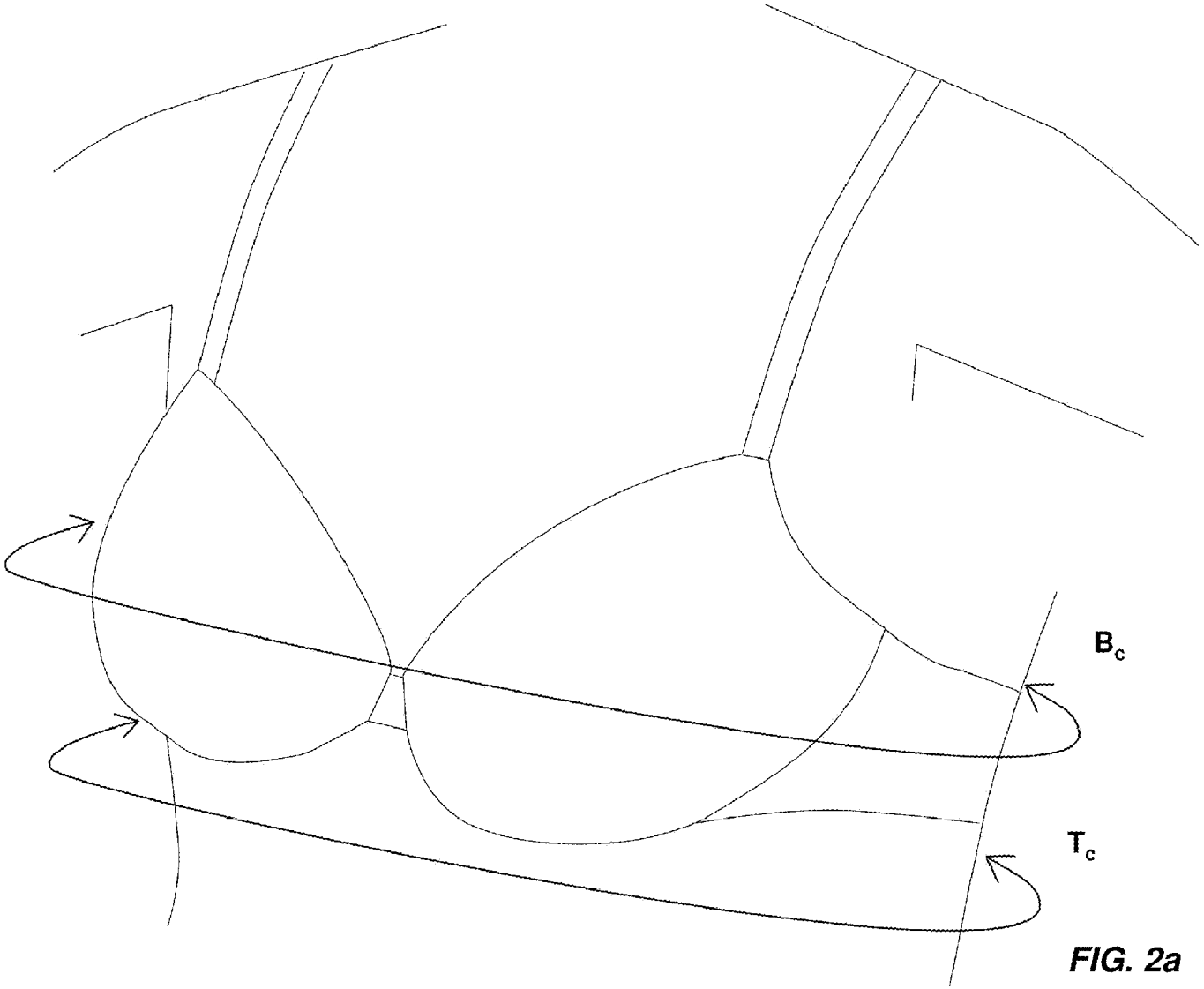
FIGS. 2*a* and 2*b* illustrate examples of various measurements that may be collected for use in creating a customizable bra.
Figure 2B:
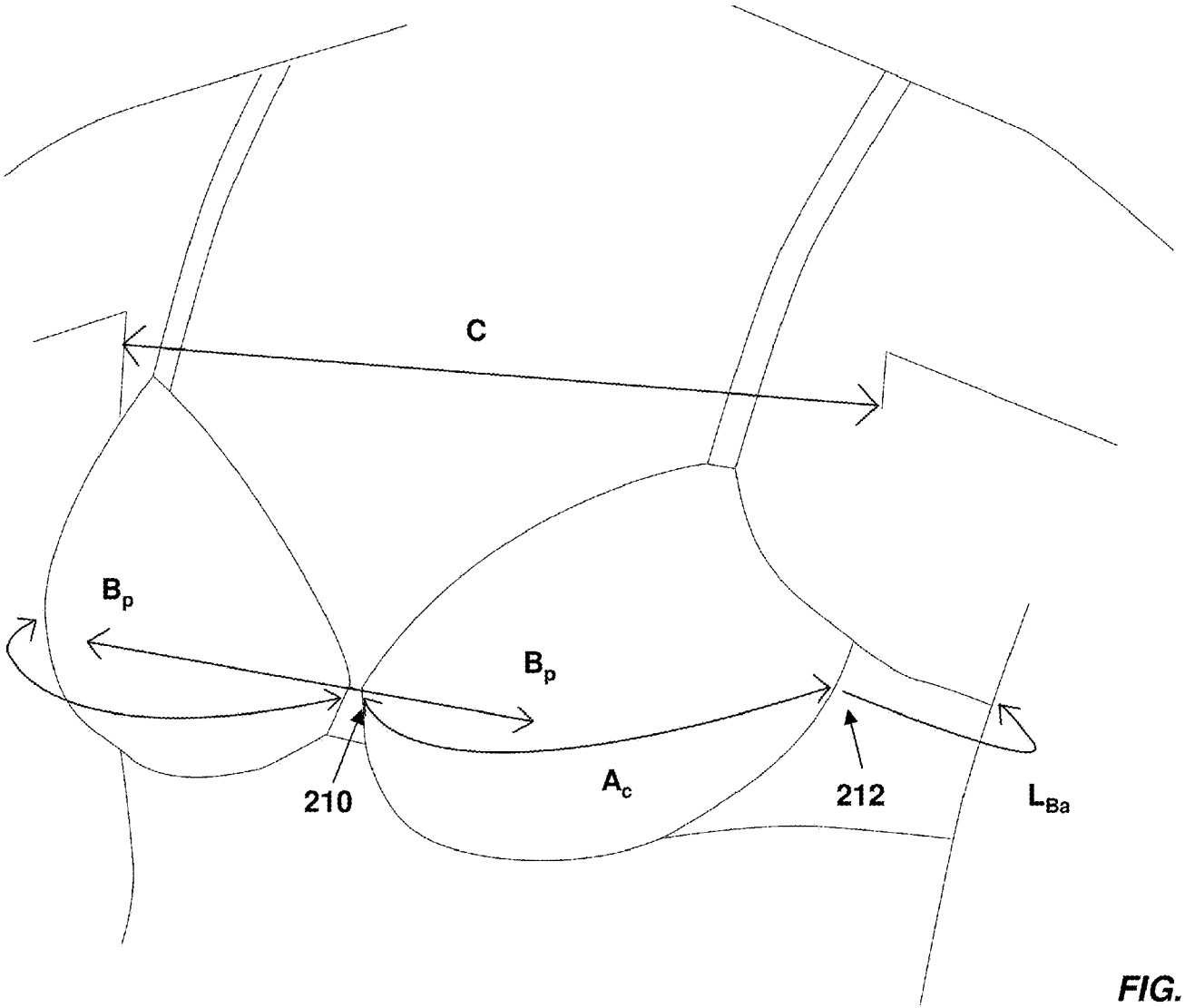

It may therefore be appreciated that if both the wire difference and the across cup difference numbers increase together at a certain rate (e.g., 1 wire size for every 0.5 inch across cup difference), the entire lower cup may grow while its proportions may remain generally unchanged. In addition, other measurements may be used to make small adjustments to the base pattern as illustrated in FIGS. 2*a* and 2*b*, including bust circumference $B_c$, torso circumference $T_c$, across upper chest distance C (see FIG. 2*b*, from the beginning of one armpit fold to the beginning of the other armpit fold), the distance between nape to waist, neck circumference at the base of the neck and the distance from the base of the neck along the ridge of the shoulder out to the end of the shoulder, and the length from bust point to bust point $B_p$ to $B_p$.

Figure 13:
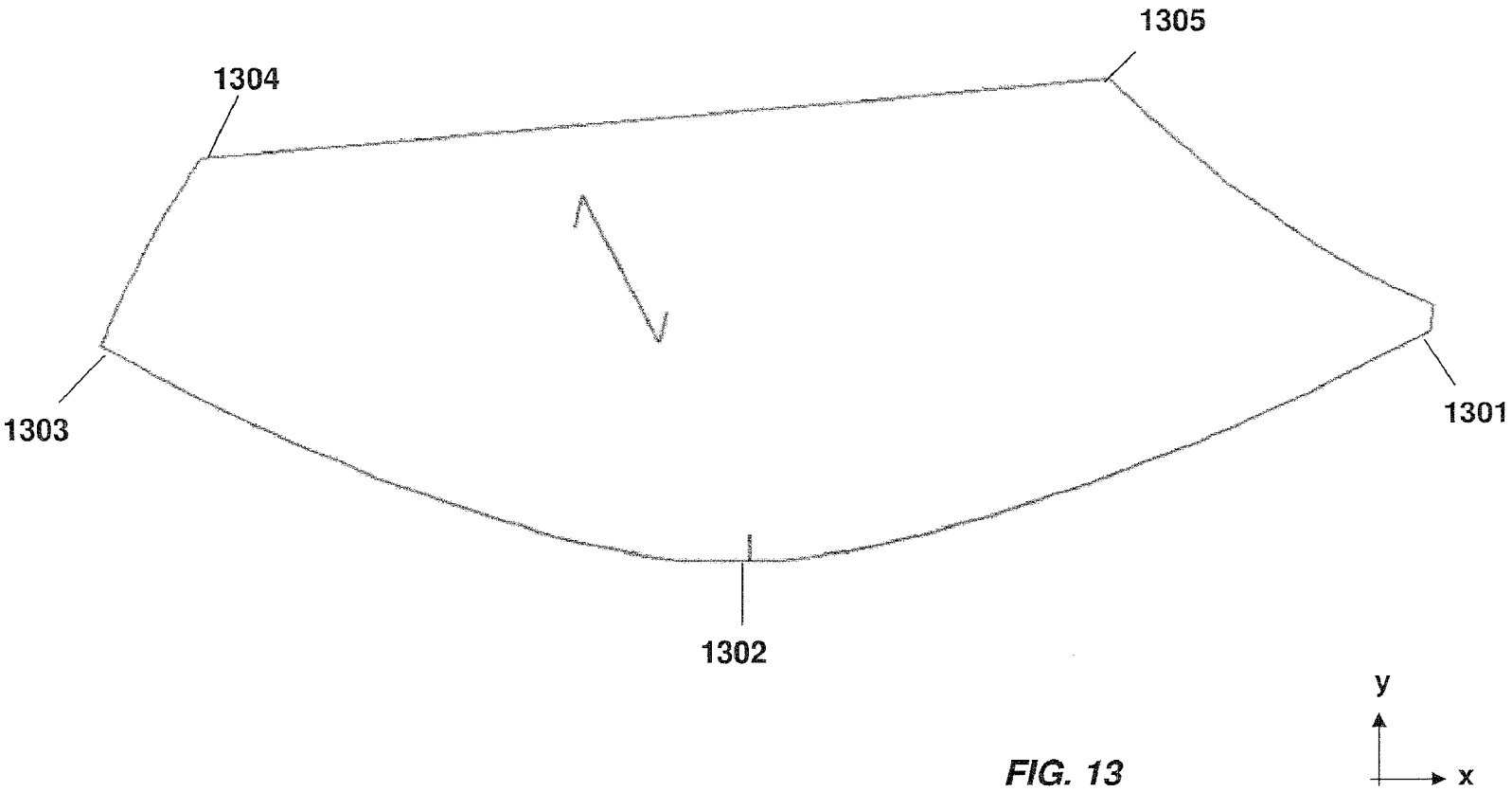
FIG. 13 illustrates an example of an upper or top cup base pattern.
Figure 14:
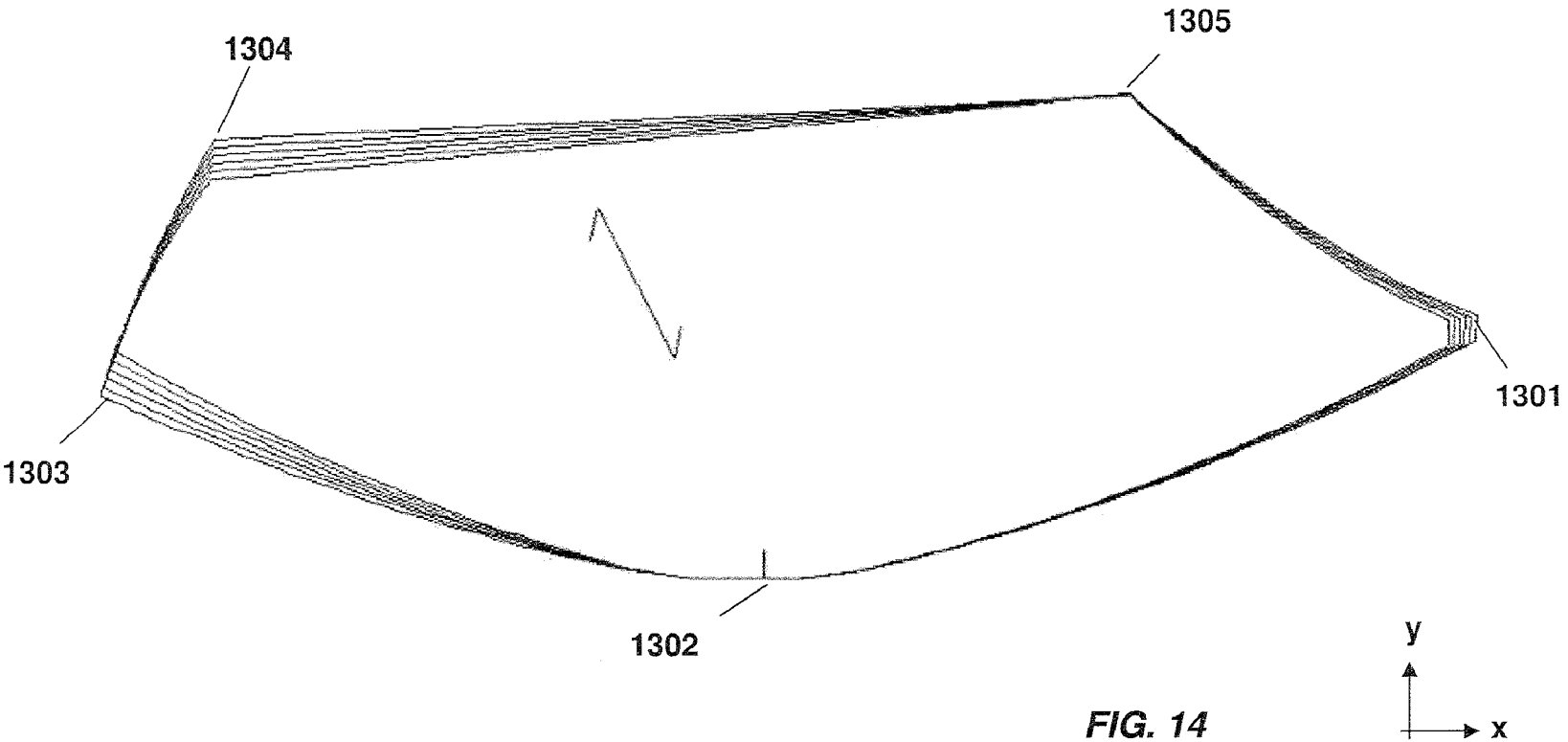
FIG. 14 illustrates an example of the effect of adjustments in underwire size on the top cup base pattern, wherein each permutation is an adjustment of the underwire by 1 size.

FIG. 13 illustrates an example of an upper cup base pattern 1300. The upper cup may provide support, shape and coverage to the top of the cup. It may be appreciated that differences in underwire size may alter the length of the wire section, i.e., the "wire line" of the upper cup between points 1303 and 1304. For example, a positive wire difference may cause the wire line to lengthen, but the overall cup may keep its general proportions. The armhole, points 1305 to 1301, and the neckline, points 1304 to 1305, may lengthen, depending on the standard model. FIG. 14 illustrates a nested pattern 1400 demonstrating an example of the effects of changes in the underwire size on the base pattern piece, wherein each sequential permutation illustrates a change of 1 underwire size. Again, the point designations between FIG. 13 and FIG. 14 are maintained. In one example, for an increase in underwire by 1 size, Table 8 illustrates the adjustment or change (Δ) that may be made to the points in relationship to the x and y axis.

TABLE 8

Adjustments in points relative to the x and y axis for an increase in underwire by 1 size.

| Point Number | ΔX (inches) | ΔY (inches) |
|---|---|---|
| Point 1301 | 0.05 | 0.01 |
| Point 1302 | 0 | 0 |
| Point 1303 | −0.02 | −0.08 |
| Point 1304 | 0 | 0.07 |
| Point 1305 | 0 | 0 |

Figure 15:
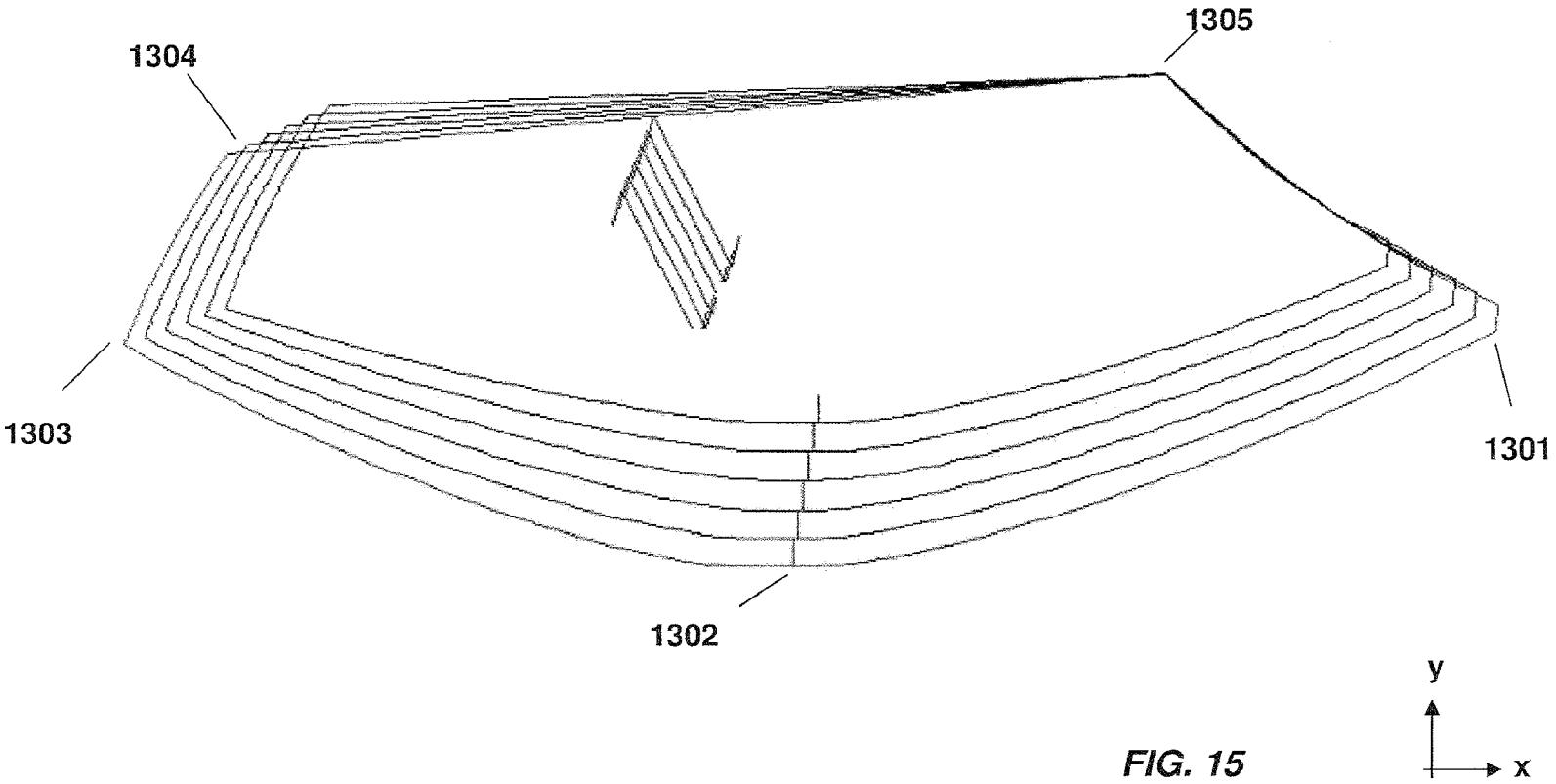
FIG. 15 illustrates an example of a nested pattern showing the effect of adjustments of across cup distance on the top cup base pattern, wherein each permutation is an adjustment of 0.5 inches.

Referring again to FIG. 13, when the across cup measurement changes, the lower line, or "seam line" from 1301 to 1303 may be altered. For example, a positive across cup difference may cause the seam line to lengthen and, with all other measurements being equal, the curve to become deeper, wherein point 1302 may move away from a straight line between points 1301 and 1303. In addition, the height of the neckline, points 1304 and 1305, and the armhole, points 1305 to 1301 may increase. However, the length of the wireline may remain unchanged if the wire difference remains at zero. FIG. 15 illustrates an example of a nested pattern 1500 demonstrating an example of the effects of changes in the across cup measurement on the upper cup pattern piece, wherein each sequential permutation illustrates a change of 0.5 inches in the across cup measurement. Again, the point designations between FIG. 13 and FIG. 15 are maintained for clarity. In one example, for an increase in the across cup measurement by 0.5 inches, Table 9 illustrates the adjustment or change (Δ) that may be made to the points in relationship to the x and y axis.

TABLE 9

Adjustments in points relative to the x and y axis for an increase in across cup measurement by 0.5 inches.

| Point Number | ΔX (inches) | ΔY (inches) |
|---|---|---|
| Point 1301 | 0.25 | 0.02 |
| Point 1302 | 0.01 | −0.13 |
| Point 1303 | −0.12 | 0.07 |
| Point 1304 | −0.12 | 0.05 |
| Point 1305 | 0.06 | 0.13 |

In addition, it may be appreciated that changes in strap size may alter any tabs (not illustrated) that might for a portion of the upper cup pattern piece. Again, other minor measurements, such as across upper chest, bust point to bust point, neck and shoulder, may have an affect on the length of the neckline and armhole and the placement of the strap on the top of the upper cup. Further, bust circumference and torso circumference may alter the "direction of the cup".

Figure 16:
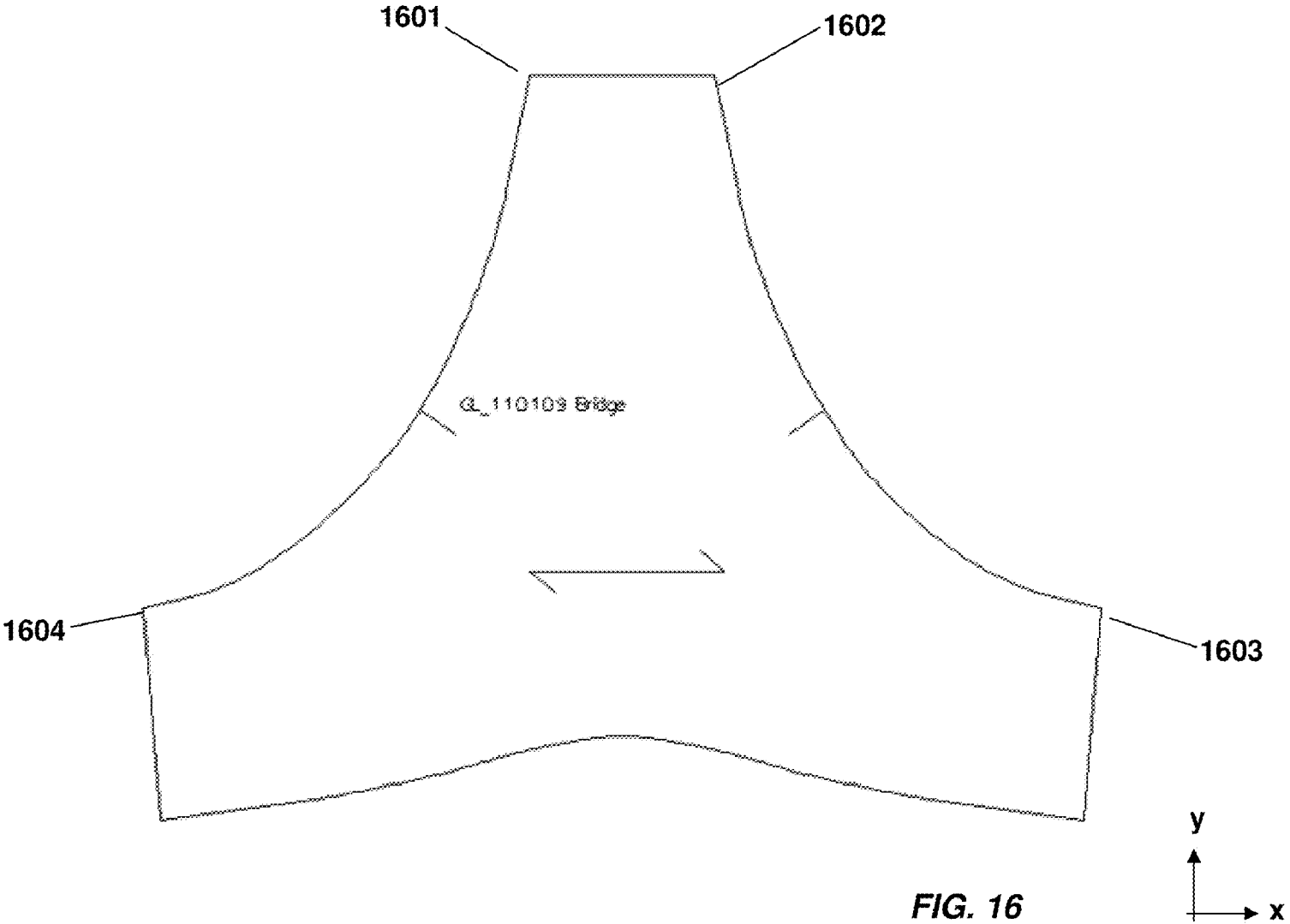
FIG. 16 illustrates an example of a bridge base pattern.
Figure 17:
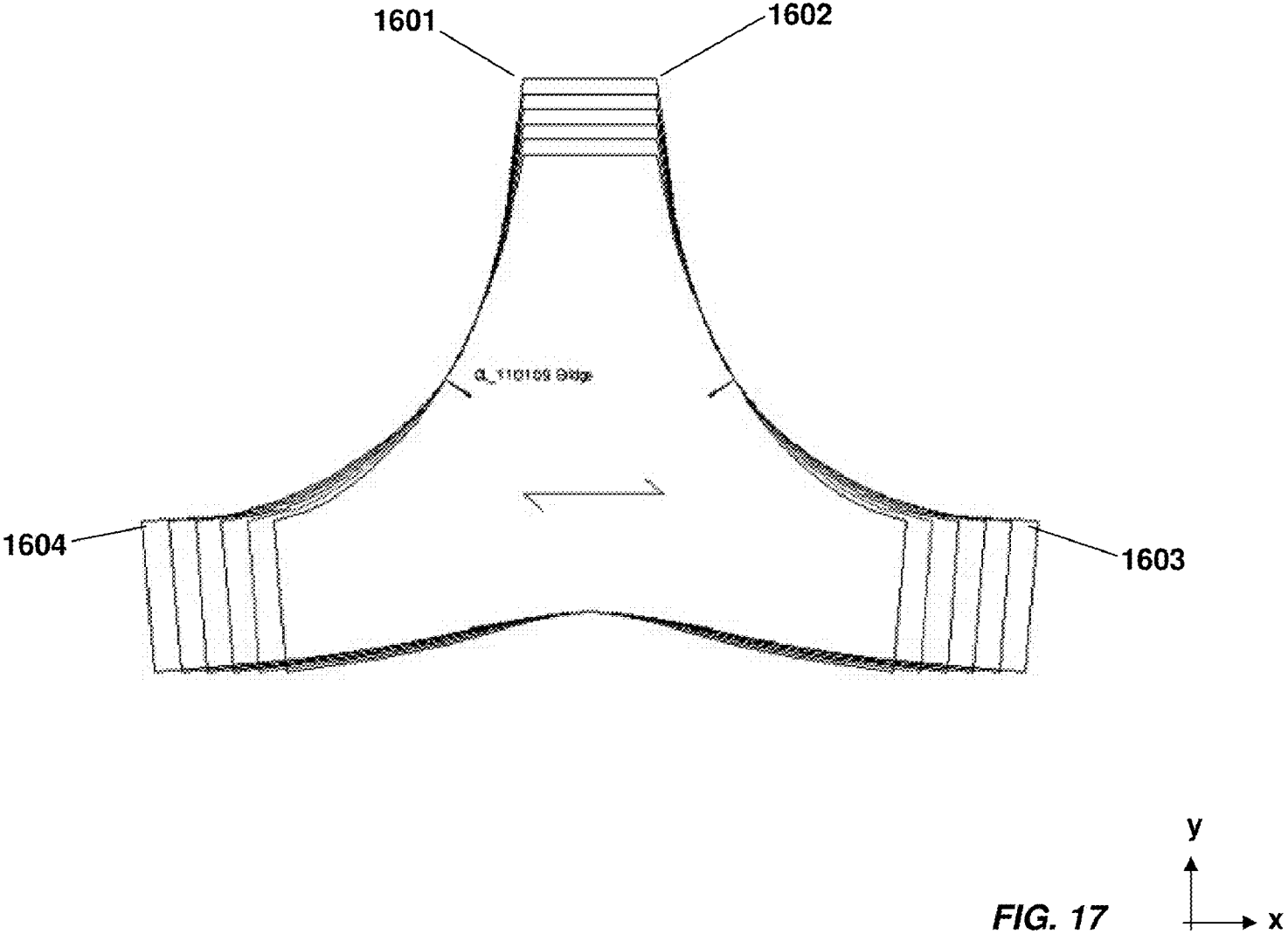
FIG. 17 illustrates an example of the effect of adjustments in underwire size on the bridge base pattern, wherein each permutation is an adjustment of the underwire by 1 size.

FIG. 16 illustrates an example of a base pattern of the bridge 1600, or center panel. The bridge may dictate the distance between the two cups. The height of the bridge may depend upon the wire difference number. For example, a positive wire difference number may provide a taller bridge. FIG. 17 illustrates an example of a nested pattern 1700 demonstrating an example of the effect of changes in the underwire size on the bridge, wherein each sequential permutation illustrate a change of 1 underwire size. As illustrated a positive underwire difference may lead to a taller and/or wider bridge. Again, the point designations between FIG. 16 and FIG. 17 are maintained. In one example, for an increase in underwire by 1 size, Table 10 illustrates the adjustment or change (Δ) that may be made to the points in relationship to the x and y axis.

TABLE 10

| Adjustments in points relative to the x and y axis for an increase in underwire by 1 size. | | |
|---|---|---|
| Point Number | ΔX (inches) | ΔY (inches) |
| Point 1601 | 0 | 0.094 |
| Point 1602 | 0 | 0.094 |
| Point 1603 | 0.082 | 0 |
| Point 1604 | −0.082 | 0 |

Figure 18:
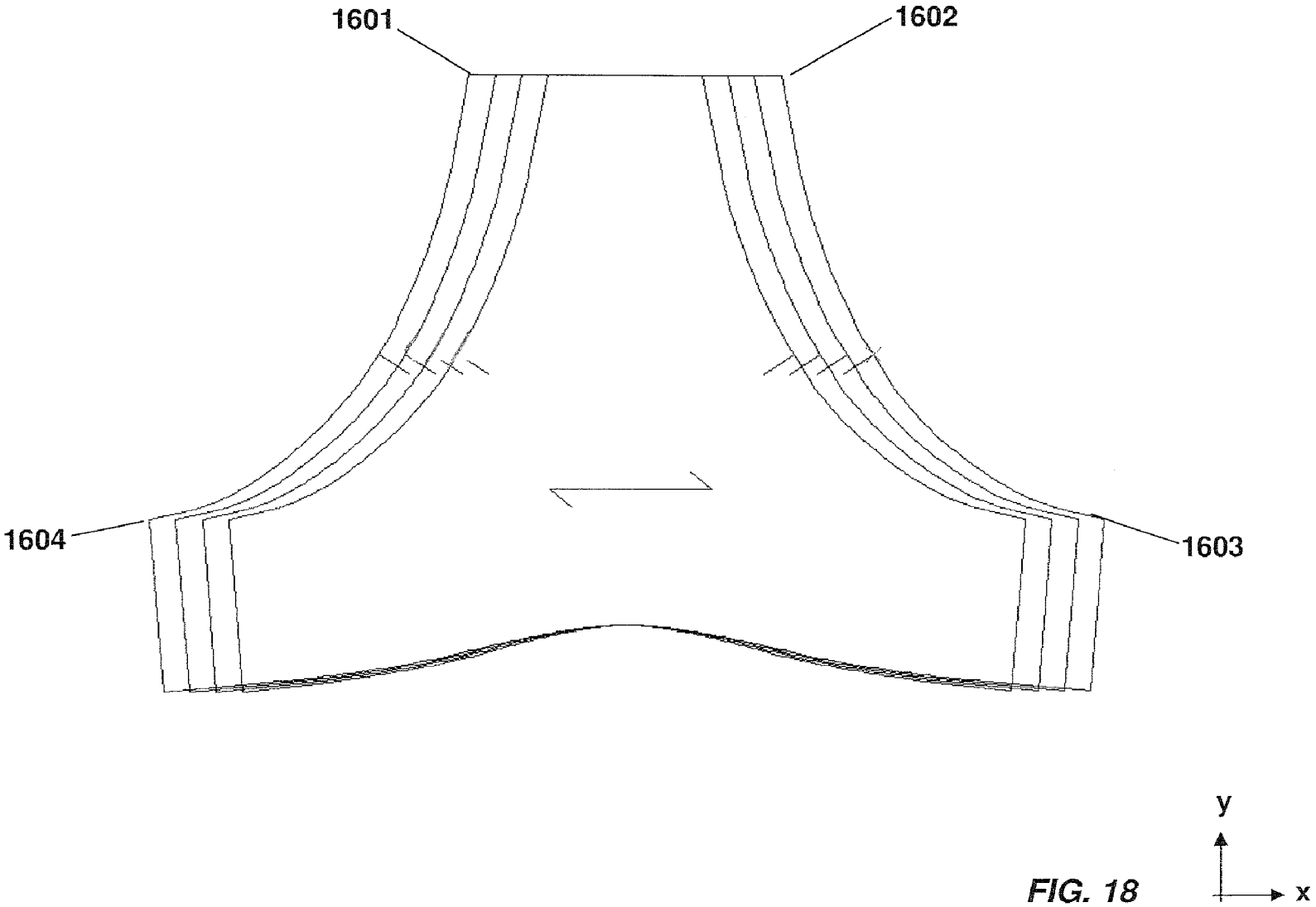
FIG. 18 illustrates an example of a nested pattern showing the effect of an adjustment of bridge width, i.e., center distance, on the bridge pattern, wherein each permutation is an adjustment of 0.375 inches.

Referring back to FIG. 16, the bridge width or center distance measurement of the customized bra may depend on the bridge difference number. A larger bridge difference number may cause point 1601 to move away from point 1602 and point 1604 to move away from point 1603. FIG. 18 illustrates an example of a nested pattern 1800 demonstrating an example of the effect of changes in the center distance measurement, wherein sequential permutations illustrate a change of 0.375 inches in bridge width. Again, the point designations between FIG. 16 and FIG. 18 are maintained for purposes of clarity. In one example, for an increase in the center distance measurement of 0.375 inches, Table 11 illustrates the adjustment or change (Δ) that may be made to the points in relationship to the x and y axis.

TABLE 11

| Adjustments in points relative to the x and y axis for an increase in the center distance measurement (or bridge width) by 0.375 inches. | | |
|---|---|---|
| Point Number | ΔX (inches) | ΔY (inches) |
| Point 1601 | −0.1875 | 0 |
| Point 1602 | 0.1875 | 0 |
| Point 1603 | 0.1875 | 0 |
| Point 1604 | −0.1875 | 0 |

Changes in the across cup measurements, i.e., across cup differences, may not affect the dimensions of the bridge.

Figure 19:
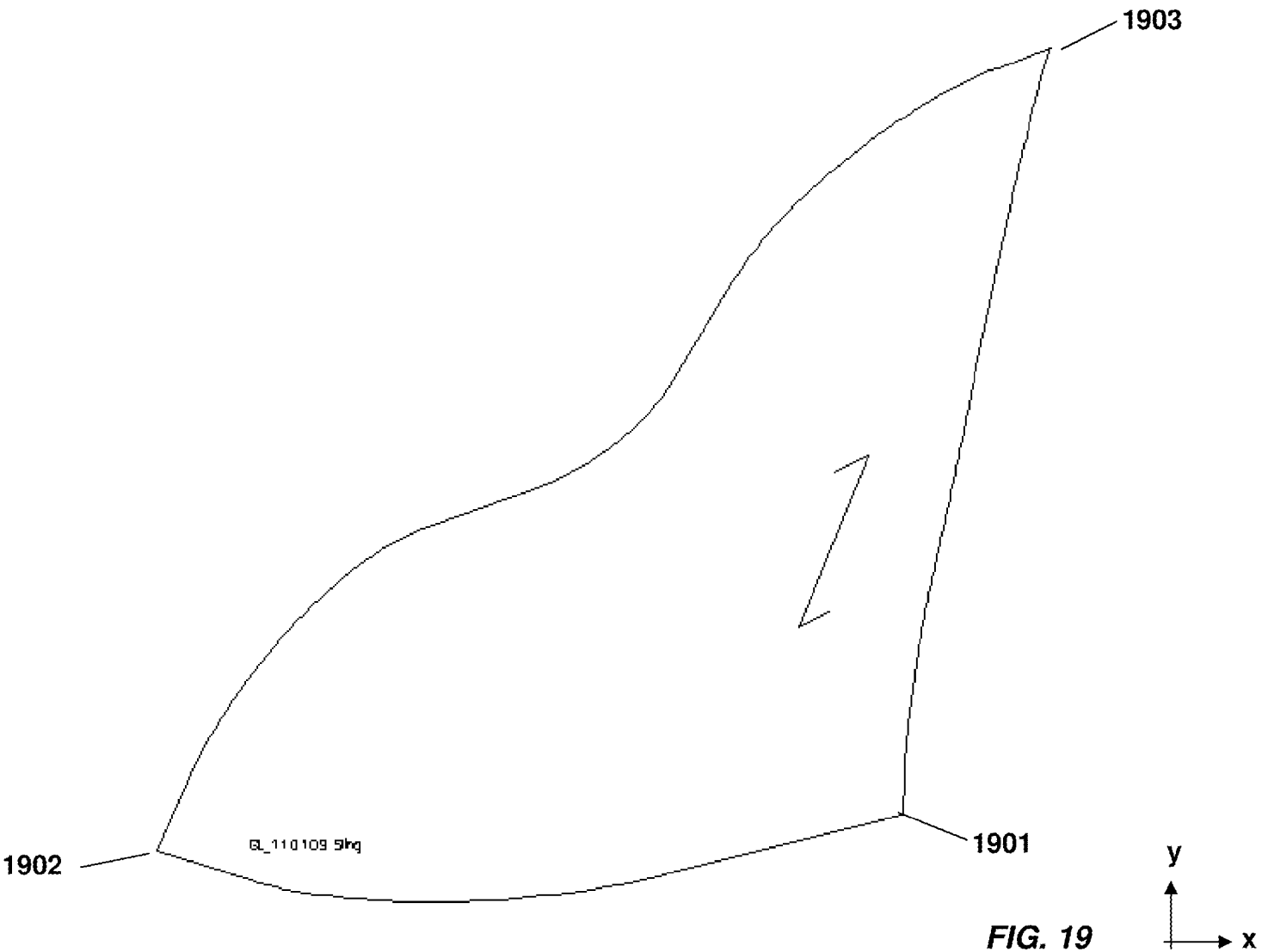
FIG. 19 illustrates an example of a sling base pattern.
Figure 20:
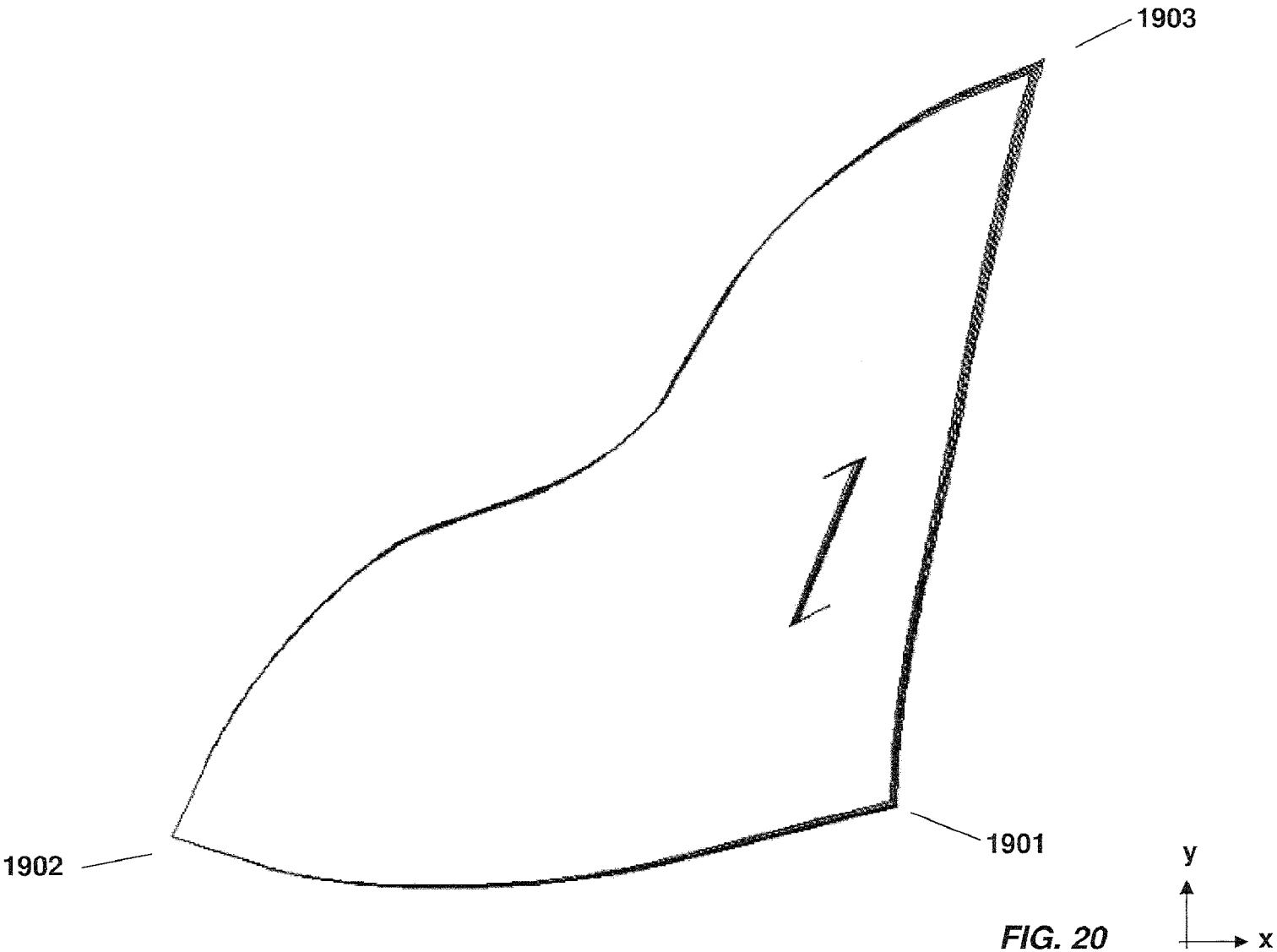
FIG. 20 illustrates an example of the effect of adjustments in underwire size on the sling base pattern, wherein each permutation is an adjustment of the underwire by 1 size.

FIG. 19 illustrates an example of a sling base pattern 1900. A sling may be used in situations where extra support may be desired or needed. The sling may provide support and/or provide lift to the cup, which may prevent the cups from pointing outward. The sling size may be adjusted based on both the selected wire size and the size of the upper and/or lower cup. As illustrated in the example of the nested patterns provided in FIG. 20, the sling 2000 is not seen to change significantly upon an adjustment in underwire size by 1 size. However, Table 12 illustrates an example of the adjustment or changes (Δ) in the points in relationship to the x and y axis based on changes in the underwire size by an increase in 1 size.

TABLE 12

| Adjustments in points relative to the x and y axis for an increase in the underwire size by 1 size. | | |
|---|---|---|
| Point Number | ΔX (inches) | ΔY (inches) |
| Point 1901 | 0.01 | 0.01 |
| Point 1902 | 0 | 0 |
| Point 1903 | 0.02 | 0.02 |

Figure 21:
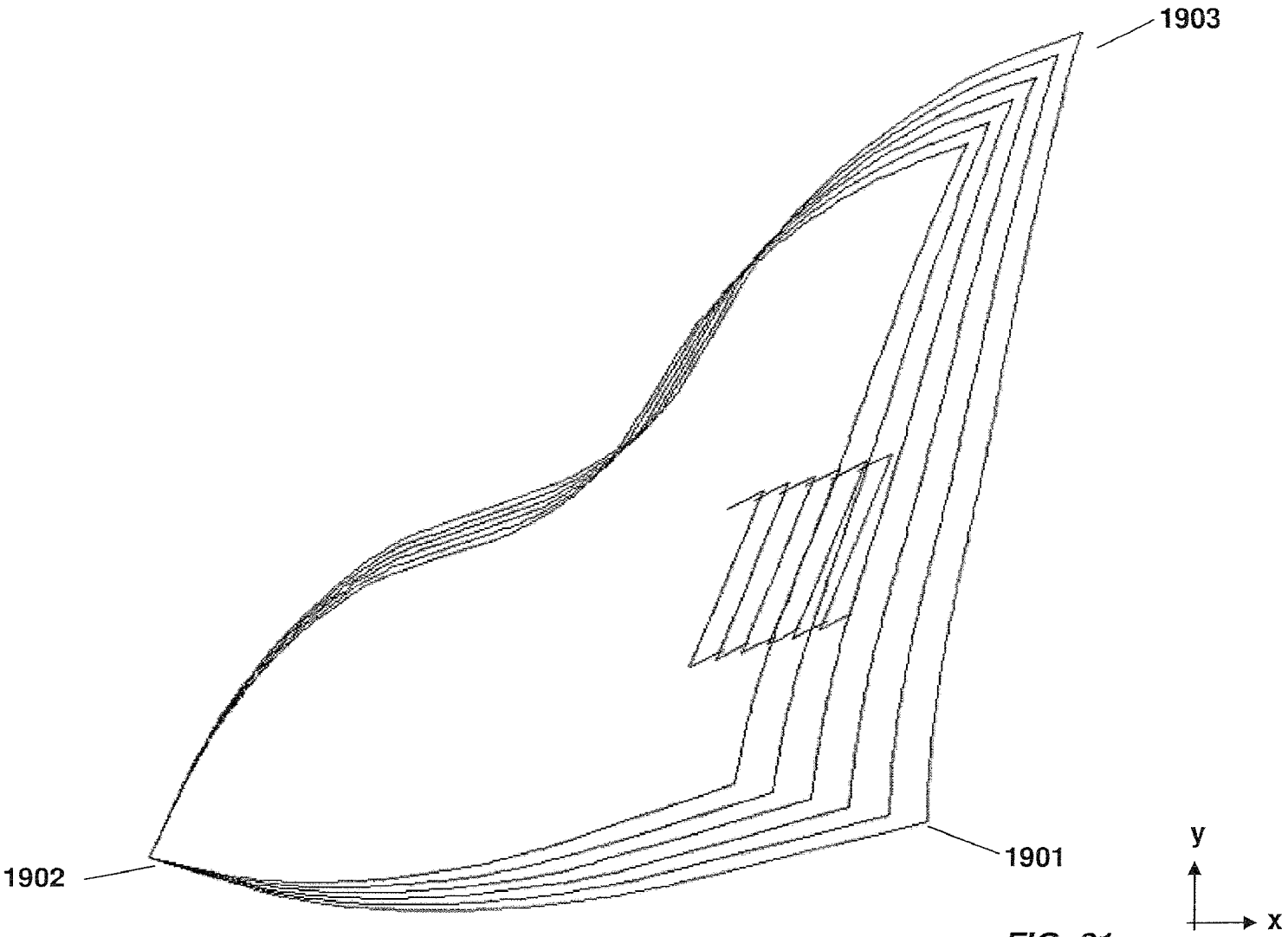
FIG. 21 illustrates an example of a nested pattern showing the effect of adjustments of across cup distance on the sling base pattern, wherein each permutation is an adjustment of 0.5 inches.

As illustrated in FIG. 21, as the across cup differences increase by 0.5 inches in each permutation, the sling pattern 2100 is seen to increase in length between points 2101 and 2102 as well as between points 2102 and 2103. Accordingly, the curvature and length between points 2103 and 2101 may be adjusted as well. Again, the point designations between FIG. 19 and FIG. 21 are maintained for clarity. In one example, for an increase in the across cup measurement by 0.5 inches, Table 13 illustrates the adjustment or change (Δ) that may be made to the points in relationship to the x and y axis.

TABLE 13

| Adjustments in points relative to the x and y axis for an increase in across cup measurement by 0.5 inches. | | |
|---|---|---|
| Point Number | ΔX (inches) | ΔY (inches) |
| Point 1901 | 0.3 | −0.06 |
| Point 1902 | 0 | 0 |
| Point 1903 | 0.18 | 0.18 |

It may be appreciated that while the above provides examples of nested patterns and adjusted measurements at 0.5 inches for across cup measurements, 1.0 inches for back measurements, underwire size adjustments of 1 size and 0.375 inches for the bridge width, it may be appreciated that adjustments may be made in other increments and values.

Accordingly, as the "difference numbers" may be used to alter the base patterns, the base patterns may be altered in various ways to develop the customized pattern. Further, in other embodiments, the "difference numbers" may be used to alter points in a CAD file, a spreadsheet, other modeling programs or on paper. As alluded to above, referring back to FIG. 6, the collected measurements may be used as inputs 601, which may be stored in memory 604 and utilized by code 612 (which may also be stored in memory 604), configured to adjust the points of a base pattern based on the difference between the points and the base points. In some examples, the collected measurement may be provided in a preformatted file type, such as a text file, a measurement file, etc. In addition, the collected measurement inputs may be provided at a distant location and sent to the memory article 604 over a network, such as by the internet. A distant location may be understood as another room, another building, across a city, across a country, in another country, etc.

The code may then access the file based upon direction of the operator. For example, a calculator may be used, or code 612 may compare the measurements and generate a set of differences. The code may be executed by the processor 606 within a computer, such as a personal computer or other computing systems. Any number of points on the pattern may be adjusted, provided that in the case of a straight line, at least two points are adjusted, and in a curved line at least three points are adjusted. Adjustments may also be made based on the composition of materials from which the customizable bra may be formed from.

It may be appreciated that the system 600 may include one or more memory articles 604, which may be located within the system 600 as illustrated, or may be located in communication with the system, through a network, which may include a wired network or wireless network. Furthermore, code 612 may be include one or more modules, that may perform different functions when executed. Code may include, for example, code that provides spreadsheet functionality, such as MICROSOFT EXCEL, macro functionality, patternmaking functionality, computer aided design functionality, etc. Furthermore, it may be appreciated that more than one processor 606 may be present in the system 600.

The data may then be presented as a customized pattern 614, which may include a set of pieces that may be used to form a garment, presently the customizable bra. The pattern may include a computer aided drawing file, a list of points corresponding to the points on different pieces or a paper pattern printed on a sheet of paper or on another substrate may be produced. The customized bras may then be uniquely produced from the adjusted patterns.

For example, the individual pieces of the pattern, or pattern pieces may include a shape defined by a number of points that form lines and curves. The pattern pieces may provide a reference for cutting fabric to the desired shapes to form the customizable bra. In some examples, the pattern pieces may be printed on a sheet of paper or other substrate and cut. The pattern pieces may then be temporarily fixed to the fabric so that the fabric may be cut into the shape of the pattern piece. In other examples, the pattern pieces may be replicated directly on the fabric, either by marking the fabric and/or cutting the fabric based on the shape of the pattern pieces. In other embodiments, the pattern may be provided as a set of points on a Cartesian plane that may then be utilized either directly or indirectly to cut a sheet of fabric into the desired pieces. Furthermore, it may be possible to provide the pattern as a series of points which may then be provided to a computer-controlled cutter, which may include a laser, blade or other cutting mechanism.

Embodiments of the methods described herein may be implemented in a system that includes one or more storage mediums having stored thereon, individually or in combination, instructions that when executed by one or more processors perform the methods. Here, the processor may include, for example, a system CPU (e.g., processor of FIG. 6) and/or programmable circuitry such as the MAC circuitry. Thus, it is intended that operations according to the methods described herein may be distributed across a plurality of physical devices, such as processing structures at several different physical locations. Of course, the operations described herein as attributable to the host system and one or more network adapters could be performed by a storage medium, on one or the other, having instructions that when executed by one or more processors perform the methods. Also, it is intended that the method operations may be performed individually or in a subcombination, as would be understood by one skilled in the art. Thus, not all of the operations of each of the flow charts need to be performed, and the present disclosure expressly intends that all subcombinations of such operations are enabled as would be understood by one of ordinary skill in the art.

The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A fitting bra for making measurements, comprising:

two underwires;

two cups, each cup supported by one of said two underwires, and exhibit an across cup size in the range of 5 inches to 20 inches;

a bridge extending between said cups, wherein said bridge has a bridge width and includes a first fastening element;

a bridge adjustment strap affixed to one side of said bridge, configured to adjust said bridge width, wherein said bridge adjustment strap includes a second fastening element configured to mechanically couple to said first fastening element;

a band affixed to the cups including a first free end and a second free end, wherein said second free end includes a third fastening element;

a back attached to said first free end and mate-able to said second free end, wherein said back has a length and includes a plurality of fourth fastening elements provided along at least a portion of the length, wherein third fastening element is configured to mechanically couple to at least one of said fourth fastening elements;

at least one strap, wherein said strap including a first end and a second end, wherein said first end is affixed to one of said cups and said second end is affixed to said band.

2. The fitting bra of claim 1, wherein said at least one strap includes two straps.

3. The fitting bra of claim 2, further comprising in the range of 5 to 30 series of fourth fastening elements provided across the thickness of said back.

4. The fitting bra of claim 1, further comprising in the range of 1 to 6 second fastening elements across the bridge adjustment strap.

5. The fitting bra of claim 1, wherein said back includes a series of fourth fastening elements provided across the thickness of said back.

6. The fitting bra of claim 1, further comprising in the range of 5 to 30 fourth fastening elements spaced across the length of the back.

7. The fitting bra of claim 1, wherein said band has two pieces, wherein one of said two pieces is affixed to one of said two cups and includes said first free end and the other of said two pieces is affixed to the other said two cups and includes said second free end.

8. The fitting bra of claim 1, wherein said cups each exhibit an across cup measurement in the range of 6 to 20 inches.

9. The fitting bra of claim 1, wherein said bridge exhibits a width in the range of 0.25 inches to 2 inches.

10. A method of providing a customized bra, comprising:

first selecting an underwire size, wherein the underwire is selected to extend underneath the breast from the point the breast meets the sternum at the infra-mammary fold, along the infra-mammary fold and to a point where the breast tissue meets the rib cage near the under arm;

selecting a fitting bra based on said underwire size, wherein said fitting bra includes two underwires, two cups, each cup supported by one of said underwires and exhibit an across cup size in the range of 5 inches to 20 inches, a bridge extending between said cups, wherein said bridge has a bridge width and includes a first fastening element, a bridge adjustment strap, wherein said bridge adjustment strap includes a second fastening element configured to mechanically couple to said first fastening element, a band affixed to the cups includes a first free end, wherein said second free end includes a third fastening element, a back attached to said first free end and mate-able to said second free end, wherein said back has a length and includes a plurality of fourth fastening elements provided along at least a portion of the length, wherein third fastening element is configured to mechanically couple to at least one of said fourth fastening elements, and at least one strap, wherein said strap including a first end and a second end, wherein said first end is affixed to one of said cups and said second end is affixed to said band;

adjusting the size of said cups by gathering said cups and measuring an across cup dimension to provide an across cup measurement;

measuring a center distance to provide a center distance measurement; and measuring a back dimension to provide a back measurement.

11. The method of claim 10, further comprising comparing said underwire size, said across cup measurement, said center distance measurement and said back measurement to a standard model to calculate difference numbers.

12. The method of claim 11, further comprising adjusting a base pattern according to said difference numbers to provide a customized pattern.

13. The method of claim 10, further comprising providing said underwire size, said across cup measurement, said center distance measurement and said back measurement as inputs into a system configured to compare said underwire size, said across cup measurement, said center distance measurement and said back measurement to a set of base measurements of a standard model to determine difference numbers.

14. The method of claim 13, further comprising providing a customized pattern by altering a base pattern using said difference numbers.

15. The method of claim 10, further comprising adjusting said bridge adjustment strap to provide said center distance.

16. The method of claim 10, further comprising adjusting said back to provide said back measurement.

17. A system for providing a customized bra including two cups, a bridge spanning between said two cups and a band, the system comprising one or more storage mediums having stored thereon, individually or in combination, instructions that when executed by one or more processors result in the following:

comparing inputs to a standard model, wherein said inputs include an underwire size, an across cup measurement, a center distance measurement and a back measurement, and said standard model includes a base underwire size, a base across cup measurement, a base center distance measurement and a base back measurement for a base pattern;

calculating difference numbers between said inputs and said standard model; and adjusting said base pattern according to said difference numbers to provide a customized bra pattern, wherein when a difference in said wire size is calculated one or more of the following are altered: a band height along which said band is affixed to said cups, the shape of a bottom curve of said cups, and the height of said bridge.

* * * * *